US005417563A

United States Patent [19]

Cirami

[11] Patent Number: 5,417,563

[45] Date of Patent: * May 23, 1995

[54] CHILD-RESISTANT LIGHTER WITH SPRING-BIASED, ROTATABLE SAFETY RELEASE

[75] Inventor: Salvatore Cirami, Long Island City, N.Y.

[73] Assignee: BIC Corporation, Milford, Conn.

[ * ] Notice: The portion of the term of this patent subsequent to Jun. 1, 2010 has been disclaimed.

[21] Appl. No.: 70,145

[22] Filed: Jun. 1, 1993

Related U.S. Application Data

[63] Continuation of Ser. No. 765,431, Sep. 25, 1991, Pat. No. 5,215,458, which is a continuation-in-part of Ser. No. 609,394, Nov. 5, 1990, abandoned, Ser. No. 438,057, Nov. 20, 1989, abandoned, Ser. No. 325,642, Mar. 21, 1989, abandoned, Ser. No. 244,149, Sep. 14, 1988, Pat. No. 4,830,603, and Ser. No. 164,329, Mar. 4, 1988, abandoned.

[51] Int. Cl.[6] ..... F23D 11/36

[52] U.S. Cl. ..... 431/153; 431/277; 222/153.01

[58] Field of Search ..... 431/129, 153, 277, 255; 222/153

[56] References Cited

U.S. PATENT DOCUMENTS

| | | | |
|---|---|---|---|
| 2,520,328 | 8/1950 | Nissen | 431/153 |
| 3,547,566 | 12/1970 | Tamarin | 431/153 X |
| 3,744,953 | 7/1973 | Herr | 431/153 X |
| 4,830,603 | 5/1989 | Cirami | 431/277 X |
| 5,074,781 | 12/1991 | Fujita | 431/277 X |
| 5,085,578 | 2/1992 | Hunter | 431/277 |
| 5,215,458 | 6/1993 | Cirami | 431/153 X |
| 5,224,854 | 7/1993 | Ansquer | 431/153 |

FOREIGN PATENT DOCUMENTS

| | | | |
|---|---|---|---|
| 56-32749 | 8/1981 | Japan | 431/153 |

*Primary Examiner*—Carl D. Price

*Attorney, Agent, or Firm*—Pennie & Edmonds

[57] ABSTRACT

A child-resistant lighter includes a housing defining a fuel compartment, normally closed valve means communicating with the fuel compartment, ignition means and a pushbutton that is depressible to open the valve means for release of fuel. A cylindrical safety release member including a base and a probe member is mounted on a horizontal top wall of the lighter's housing with the safety release's base slidable on the top wall and the probe abutting a horizontal undersurface of the pushbutton whereby the pushbutton is normally blocked against depression. Wall structure dependent from the pushbutton's undersurface is arranged to restrict the directions in which it is possible to move the probe, such that, only certain rotational and horizontal manipulations of the safety release will move the probe from a given rest position whereat it blocks depression of the pushbutton to a given alternate position whereat a clearance provided in the pushbutton's undersurface over the probe permits depression of the pushbutton.

21 Claims, 8 Drawing Sheets

CHILD-RESISTANT LIGHTER WITH SPRING-BIASED, ROTATABLE SAFETY RELEASE

RELATED U.S. APPLICATION DATA

This is a continuation of U.S. patent application Ser. No. 07/765,431, filed on Sep. 25, 1991, which issued on Jun. 1, 1993 as U.S. Pat. No. 5,215,458, which is a continuation-in-part of U.S. patent application Ser. No. 07/609,394 filed on Nov. 5, 1990, abandoned; U.S. patent application Ser. No. 07/438,057 filed on Nov. 20, 1989, abandoned; U.S. patent application Ser. No. 07/325,642 filed on Mar. 21, 1989, abandoned; U.S. patent application Ser. No. 07/244,149 filed on Sep. 14, 1988, which issued on May 16, 1989 as U.S. Pat. No. 4,830,603; and U.S. patent application Ser. No. 07/164,329, filed on Mar. 4, 1988, abandoned.

RELATED U.S. DISCLOSURE DOCUMENT PROGRAM DATA

Priority for new subject matter contained herein is claimed based upon Disclosure Document Nos. 266173 filed on Oct. 31, 1990, 284493 filed on Jun. 17, 1991 and 287805 filed July 29, 1991. BACKGROUND OF THE INVENTION 1. Introduction Children playing with cigarette lighters frequently cause fires which result in death or injury to themselves or others. Analysis of fire incidents caused by children playing with cigarette lighters indicates that disposable lighters are principally implicated in those fires in which the type of lighter could be determined and that the children involved are typically younger than six—most fires caused by children three or four years old.

On May 3, 1985, the U.S. Consumer Product Safety Commission ("CPSC") received a petition requesting and is presently engaged in a proceeding to establish regulations applicable to disposable lighters to make same child-resistant.

In response to media announcement of said petition, this inventor developed, as referenced above, successively improved embodiments of a child-resistant lighter, all of which embodiments are characterized by a certain basic concept. This document discloses embodiments patentably distinguishable from the earlier efforts, but, at root, still based upon the same basic concept. The referred-to basic concept is described below. The terms contained within quotes are those consistently used in the above-referenced prior disclosures. The same terms have been used in the following statement in order to facilitate comparison with and documentation by the prior disclosures; but different terms are preferred herein for certain corresponding elements of the new embodiments.

Basic Concept

A "probe" is spring biased to stand at a given rest position under and in abutment against a "low-ceiling" formed at the underside of the lighter's pushbutton whereby the pushbutton is normally blocked against depression. So long as the probe stands under any portion of said low ceiling, the pushbutton remains blocked against depression by manipulation of a "safety release" fixed to the probe, the probe is movable—against the resistance of its biasing spring—from its rest position to a given alternate position under the low ceiling. Wall structure of the pushbutton arranged depending from the low ceiling restricts the directions in which it is possible to move the probe, such that, the user must manipulate the safety release in different directions in order to cause the probe to travel from its rest position to its alternate position; i.e., a multiple-step mode of operation is required. At such alternate position, a "high ceiling segment" of the low ceiling provides a clearance over the probe that allows the pushbutton to be depressed. When moved to its alternate position, the probe is under the influence of return biases corresponding to the directions in which the probe was moved. After moving the probe to its alternate position, the user lets go of the safety release, allowing the probe to respond to the return biases effective upon it. The probe would immediately spring back to its rest position except that an "inside corner" formed in the high ceiling segment-/alternate position of the probe in its return bias path catches the probe and holds it at its alternate position. On depression of the pushbutton, a "wedge surface" formed within the "high ceiling segment" over the inside corner, engages and pushes the probe out of the inside corner. So long as the pushbutton is held depressed while the flame is being produced, the low ceiling will be in a correspondingly lowered position and therefore block reentry of the probe under the low ceiling. However, when the pushbutton is released and the low ceiling is thereby returned to its normal elevation, the probe, under the impetus of return biases effective upon it, returns to its rest position, whereby, the pushbutton is automatically again blocked against depression. The system is therefore "passive", meaning that, the pushbutton automatically relocks itself.

Limitation of Early Embodiments

In the above-referenced applications and patent the basic concept described above was given physical expression by structure including a long, vertically positioned "safety release spring" preferably mounted within a "second compartment" of the lighter's housing alongside that first compartment of the housing defining its fuel reservoir. Portions of such safety release spring defined the "probe", "safety release" and "biasing spring" referred to in the statement of basic concept presented above. This safety release spring could not be incorporated in a current disposable lighter product without either (i) significantly increasing the current size of its housing or, in the alternative, (ii) significantly reducing the current fuel capacity, in each case, in order to give effect to said second compartment. It would have been necessary, therefore, to manufacture an entirely new product assembled by new machinery, as opposed to effecting relatively minor modifications of an existing product assembled by existing machinery.

Must Be Usable In Current Product

As indicated above, it is the disposable type of cigarette lighter that is principally implicated in fires caused by children playing with lighters. Unless one is prepared to effectively build a new factory from the ground up for manufacture of an entirely new lighter product, a proposed child-resistance-effecting mechanism must be incorporatable into current disposable lighter products. The primary objective of the present improvement is to convert existing lighter products into ones that are child-resistant. Accordingly the portion of the modified conventional lighter comprising the improvement is constrained by considerations pertaining to its environment of specific application. Among other constraints, modifications of the conventional product converting it to one that is child-resistant must be restricted to the upper end portion of a given current disposable lighter product in order that existing manufacturing facilities and methods of assembly can be utilized.

Advantages of Present Embodiments

The improved embodiments disclosed herein are based upon and thereby retain all advantages of the basic concept described above but are compatible with incorporation in a given manufacturer's current disposable lighter product without significant effect on the external shape or dimensions thereof in order to be manufacturable by existing facilities according to conventional practice. The improved embodiments are characterized by ideas in addition to those characterizing the basic concept and attain other and different results such as compatibility with assembly by automatic machinery and more convenient mode of operation likely to encourage widest adult usage.

More particularly, the safety release is now in the form of a cylindrical member that is mounted on a horizontal top wall of the lighter's housing under its pushbutton. The safety release is mounted so as to be rotatable about a vertical axis but also slidable on such top wall away from said vertical axis. A safety release biasing spring secured between the safety release and either the pushbutton or the lighter's housing biases the safety release to resist displacement both rotationally and horizontally across said top wall. The safety release biasing spring is preferably a conical helical spring, a form of spring which has been found to produce certain desired return biases; namely, a rotational return bias when one end is rotated while the opposite end is held stationary and a horizontal return bias when one end is forced horizontally out of concentric alignment with the opposite end. A safety release biasing spring in such form is mountable within the upper end portion of the lighter without significantly altering the internal dimensions of the main body portion of a current lighter product. The arrangement is such that the safety release is accessible for grasping between the thumb and forefinger of one hand while the main body portion of the lighter is held in the palm o said one hand. A probe member forms a part of and rises from the safety release to normally abut a horizontal undersurface of the pushbutton whereby the pushbutton is normally blocked against depression. By manipulation of the safety release using the thumb and forefinger applied to opposed sides thereof, the probe is moved from an initial or rest position to an alternate position whereat an inside corner formed in the pushbutton holds the probe at its alternate position so that the user can shift his thumb to the pushbutton for depression of it. A clearance formed in the pushbutton over the probe permits depression of the pushbutton when the probe is located at its alternate position. On depression of the pushbutton a wedge surface formed in the pushbutton engages the probe and pushes it out of the inside corner; and, when the pushbutton is released after having been depressed, the probe, impelled by the return biases effective upon it, returns to its rest position whereby the pushbutton automatically is returned to its locked condition. Another advantage of the improved embodiments is that they comprise elements which can be assembled into a current lighter product by simple "straight down" movements of assembling machinery and accordingly are compatible with high speed assembly by machine. All embodiments require a multiple-step mode of manipulation of the safety release in order to render the pushbutton depressible; in each embodiment, the probe being cooperatively related to the undersurface of the pushbutton such that it is impossible for a child to circumvent the multiple-step feature even if the child uses both hands to manipulate the lighter in any manner whatsoever.

2. Field of Invention

Lighter Having Depressible Pushbutton Causing Fuel Release

The present improvement is applicable to any lighter that includes (1) a housing defining a fuel compartment or reservoir, (2) fuel release means communicating with the reservoir, (3) ignition means for igniting released fuel and (4) a pushbutton that is depressible against the resistance of spring means; arranged such that (5) depression of the pushbutton causes the fuel release means to release fuel from the fuel compartment.

In a lighter as above defined, the present invention provides a child-resistance-effecting mechanism including a cylindrical, user manipulable, safety release mounted under the pushbutton, wherein the safety release includes a probe that normally blocks depression of the pushbutton, wherein, by a multiple-step mode of operation of the safety release which a child cannot avoid by two-handed manipulation of the lighter the probe is movable from a given initial or rest position whereat the pushbutton is blocked against depression to an alternate position whereat a clearance over the probe permits depression of the pushbutton, and wherein, when the pushbutton is depressed and then released, the probe, in response to the return bias of a cooperating safety release biasing spring against the resistance of which the safety release has been operated, the probe returns to its rest position, whereby, the pushbutton is automatically again blocked against depression.

Accordingly, the field of the invention encompasses generally any lighter wherein fuel is released by depressing a pushbutton, particularly certain cigarette lighters, including disposable cigarette lighters.

Definition of "Pushbutton"

The term "pushbutton" as used herein means any member incorporated in a flame-producing lighter to which member the user applies his/her thumb for exerting force that causes movement of such member from one position to another where the result of such movement is that fuel is caused to escape from a fuel compartment for exposure to ignition means.

Field Further Defined

Cigarette lighters are presently being marketed having a wide variety of different constructions. The invention is applicable to those lighters constructed as defined in the first paragraph under this heading; i.e., any lighter comprising items (1) through (4) functioning as defined in item (5) of said first paragraph. The definition of "pushbutton", especially when considered in light of the preceding paragraphs, including said first paragraph, makes it clear that, for purposes of applicability to and operativeness of the present invention in such defined classification of cigarette lighter, it is immaterial:

(a) whether the pushbutton is movable along a straight axis or an arcuate axis; i.e., whether the pushbutton is (i) a "true pushbutton" that is vertically movable—as is utilized in a piezoelectric type of lighter, or, (ii) forms one end of a pivotally mounted lever and thereby moves arcuately—as is utilized in a flint and abrasive wheel type of lighter;

(b) what type of ignition means is utilized to ignite the released fuel—piezoelectric or flint and abrasive wheel;

(c) whether the lighter is the disposable type having its housing economically constructed of plastic or is the durable type having its housing constructed of metal for many years of use;

(d) whether the lighter is marketed having its fuel compartment initially filled or initially empty; i.e., whether the lighter is (i) the disposable type having its fuel compartment initially filled and not refillable, (ii) the disposable type having its fuel compartment either initially filled or initially empty but in either case refillable, or (iii) the durable type having a fuel compartment constructed for an unlimited number of refillings;

(e) what type of fuel and corresponding type of fuel release device is used; i.e., (i) whether the fuel is in the form of a liquid and the "fuel release device" is a wick that is normally covered by the pushbutton or an element associated with the pushbutton, which wick is uncovered by depression of the pushbutton—as utilized in certain durable-type lighters, or, (ii) whether the fuel is in the form of a combustible gaseous fluid contained in the fuel compartment under pressure and the "fuel release device" is a valve mechanism having a vertically slidable nozzle element that is spring-biased normally closed but engaged with the pushbutton such that depression of the pushbutton lifts the nozzle element to an open-valve condition that releases such fluid in a gaseous state—as utilized in disposable lighters;

(f) whether the ignition means is (i) engaged with, actuated directly by and as a consequence of depression of the pushbutton—as in the case of the piezoelectric type of lighter which automatically generates an electric spark when the pushbutton is depressed to release fuel; or, (ii) not engaged with the pushbutton but actuated by the user substantially simultaneously with depression of the pushbutton for release of fuel—as in the case of the flint and abrasive wheel type of lighter wherein the user rotates the abrasive wheel by a movement of the thumb that ends with depression of the pushbutton;

(g) whether (i) the upper end portion of the lighter's housing is formed in one piece with its main body portion to define a fuel compartment that is initially open only at the bottom and then fitted with a bottom plug—as shown in FIG. 3 of the accompanying drawings, or, (ii) the main body portion of the lighter's housing formed initially open only at the top and then fitted with a top plug and the upper end portion of the lighter's housing is formed as a distinct component that secures a snapped—on attachment to such top plug-as shown in FIG. 18 of the accompanying drawings; and, (h) in the case of a disposable type of lighter wherein the pushbutton is formed by one end of a pivotally mounted lever the opposite end of which is engaged with a vertically slideably mounted nozzle element of a valve mechanism and wherein spring means is arranged to simultaneously bias such nozzle element normally closed and said pushbutton upwardly whereby the pushbutton is depressible against the resistance of such spring means: whether such spring means is (i) mounted under said pushbutton—as is conventionally done in the case of the construction described in (g)(i) above, or, (ii) incorporated in said valve mechanism—as is conventionally done in the case of the construction described in (g)(ii) above.

Clearly, it is intended that the field of the present invention be interpreted to encompass any presently existing or future construction of cigarette lighter wherein fuel is released by depressing a pushbutton (as the term "pushbutton" is defined above). Anticipating future possibilities, it is believed to be within the skill of the mechanic to effect hybrid constructions of the above-mentioned presently existing types of cigarette lighters; e.g., the housing construction conventionally associated with one type of disposable lighter could be combined with the valve/pushbutton biasing spring arrangement conventionally associated with another type of disposable lighter. Likewise, it is believed to be within the skill of the mechanic to reduce the size of the spark generating elements and/or rearrange the spring structure presently existing under the pushbutton of a conventional piezoelectric lighter to provide a space for incorporation of the present invention.

SUMMARY OF THE INVENTION

The invention provides a child-resistant lighter including a pushbutton that is depressible to cause release of fuel but is normally locked, having a multiple-step pushbutton unlocking system that is impossible for a child to circumvent by two-handed manipulation of the lighter, and having a passive pushbutton relocking system.

The invention is characterized by a basic concept wherein:

(1) a probe member is secured to and movable by a user-manipulable safety release member;

(2) the probe stands at a given rest position under and in abutment against a planar undersurface (in prior disclosures termed a "low ceiling") of the pushbutton whereby the pushbutton is normally blocked against depression;

(3) a safety release biasing spring is secured between the safety release and suitable other structure of the lighter to cause the safety release to yieldably resist all movement of it;

(4) by manipulation of the safety release against the resistance of the cooperating safety release biasing spring, the probe is movable from its rest position to a given alternate position located beyond said undersurface whereat a clearance is provided over the probe that permits depression of the pushbutton;

(5) wall structure of the pushbutton extending between the probe's rest and alternate positions restricts the directions in which it is possible to move the probe, such that, the user must manipulate the safety release in distinctly different directions in order to complete movement of the probe from its rest position to its alternate position;

(6) when located at its alternate position the probe is biased to return to its rest position along a given return bias path which is the vector sum of the directions in which the safety release biasing spring was flexed by movement of the probe to its alternate position;

(7) upon release of the safety release after movement of the probe to its alternate position, an inside corner formed in the pushbutton at the alternate position of the probe in its return bias path catches the probe and holds it at its alternate position;

(8) depression of the pushbutton lowers a wedge surface of the pushbutton that pushes the probe out of the inside corner; and (9) when the pushbutton is released the probe returns to its rest position in response to its return bias, thereby automatically again blocking the pushbutton against depression.

One object of the invention is to provide an embodiment according to the above-stated concept that enables conversion of a conventional disposable lighter into one that is child-resistant by modifications limited to the upper end portion of the current product; so that, internally, the current capacity of the fuel compartment is not reduced; and, externally, neither the shape nor the size of the main body portion of the current product is affected; whereby, the child-resistant version can be manufactured by the same facilities previously used to manufacture the conventional product. This object is attained by an embodiment wherein:

the safety release is in the form of a cylindrical member that includes a base and said probe member;

the upper end portion of the housing of the current lighter product is provided with a horizontal top wall having opposed edges which are free;

the safety release is mounted on such horizontal top wall such that the safety release is rotatable about a vertical axis but is also slidable on the horizontal top wall away from said vertical axis;

the safety release has a diameter large enough that it is manipulable by grasping opposite sides thereof between the thumb and forefinger of one hand while holding the main body portion of the lighter's housing in the palm of said one hand, so that, the position in which the lighter is held for manipulating the safety release is substantially the same as that in which the lighter is held when depressing the pushbutton to produce the flame—this being the reason for specifying above "a horizontal top wall having opposed edges which are free"; i.e., so that opposite sides of the safety release are accessible;

the safety release biasing spring is of a construction that resistively permits both rotation of the safety release around said vertical axis and also sliding horizontal movement of the safety release on the horizontal top wall away from said vertical axis; and, the safety release biasing spring has one end nonrotatably secured to the safety release and another end nonrotatably secured to structure of the lighter that is movable neither rotationally nor horizontally, whereby, forcible displacement of the safety release, either rotationally or otherwise in a horizontal plane, in each case, against the resistance of the safety release biasing spring, imparts corresponding return biases to the safety release and thereby its probe member.

Another object is to provide an embodiment wherein the safety release biasing spring is arranged extending between a top portion of the safety release and a recessed underside portion of the pushbutton.

Another object is to provide an embodiment wherein the horizontal top wall is provided with a recess deep enough to fully accommodate the safety release biasing spring; the safety release biasing spring is located within such deep recess; and, the safety release biasing spring has one end nonrotatably secured to an underside portion of the safety release, and another end nonrotatably secured to wall structure of the lighter's housing defining said deep recess.

Another object is to provide embodiments as described in the last two objects but, in each case, enabling "straight-down assembly by machine" of the safety release and the safety release biasing spring. This object is attached, in each case, by the safety release biasing spring being a conical helical spring positioned so that its coils encircle a vertical axis, having an upper end portion and a lower end portion each of which end portions is free and extends across the diameter at that end of the spring; and, in the case of that embodiment wherein the safety release biasing spring is mounted on top of the safety release:

the recessed underside portion of the pushbutton being provided with a split boss adapted to receive the upper end portion of the safety release biasing spring; and, the top portion of the safety release being provided with a split boss adapted to receive the lower end portion of the safety release biasing spring;

and, in the case of that embodiment wherein the safety release biasing spring is mounted under the safety release:

the underside portion of the safety release being provided with a split boss adapted to receive the upper end portion of the safety release biasing spring; and, the deep recess having a bottom provided with a split boss adapted to receive the lower end portion of the safety release biasing spring.

It was stated above that "wall structure of the pushbutton extending between the probe's rest and alternate positions restricts the directions in which it is possible to move the probe, such that, the user must manipulate the safety release in distinctly different directions in order to complete movement of the probe from its rest position to its alternate position." Final objects of the invention relate to arrangements of such wall structure which impose specifically different multiple-step modes of manipulating the safety release.

Specifically:

Another object is to provide an embodiment wherein said wall structure describes an arcuate wall having a uniform radius and a given length and extends between first and second notches which define the rest and alternate positions of the probe, respectively; wherein the probe is normally received in the first notch so that the safety release cannot initially be rotated but must first be moved horizontally away from said vertical axis in order to pull the probe out of the first notch; and wherein the safety release must then be rotated in order to move the probe around said arcuate wall and caused to enter the second notch.

Another object is to provide an embodiment wherein said wall structure is arranged to permit initial rotation of the probe away from its rest position but, halfway between the probe's rest and alternate positions, presents an obstruction that requires pulling the safety release away from said vertical axis in order to circumvent such obstruction, and then permits a further rotation of the safety release to bring the probe to its alternate position.

A final object is to provide an embodiment that enables conversion from one to the other of the multiple-step modes of operation described in the last two paragraphs merely by substituting a pushbutton having one arrangement of wall surfaces for a pushbutton having the other arrangement of wall surfaces.

BRIEF DESCRIPTION OF THE DRAWINGS

FIG. 8 shows the probe having been pulled out of the first notch.

FIG. 9 corresponds with FIG. 5 in that FIG. 9 likewise shows the probe having been rotated to and now located at its alternate position located within a second notch.

FIG. 10 corresponds with FIG. 6 in that FIG. 10 likewise shows the pushbutton is depressed position and the wedge surface having pushed the probe outwardly.

FIG. 11 shows the pushbutton still depressed and shows a phase of the operation that occurs instantly subsequent to the operation depicted in FIG. 10, whereby, the probe positively circumvents an inside corner of the pushbutton. When the pushbutton is released, the probe will return to its rest position and the safety release will return to its initial position, in each case, as shown in FIG. 7.

FIG. 14 shows the probe having been rotated 45 degrees to a rotated position that is just short of an obstruction to further rotation that is effected by the dependent wall structure of the pushbutton. When rotated to precisely such correct position, the probe is correctly positioned for passage through a gap in the dependent wall structure of the pushbutton.

FIG. 15 shows the probe having been pulled through the gap and now rotatable another 45 degrees to its alternate position. The operation subsequent to arrival of the probe at its alternate position in this configuration of the pushbutton is identical to that of the first configuration of the pushbutton.

Finally.

DESCRIPTION OF PREFERRED EMBODIMENTS

Overview

Figure 1:
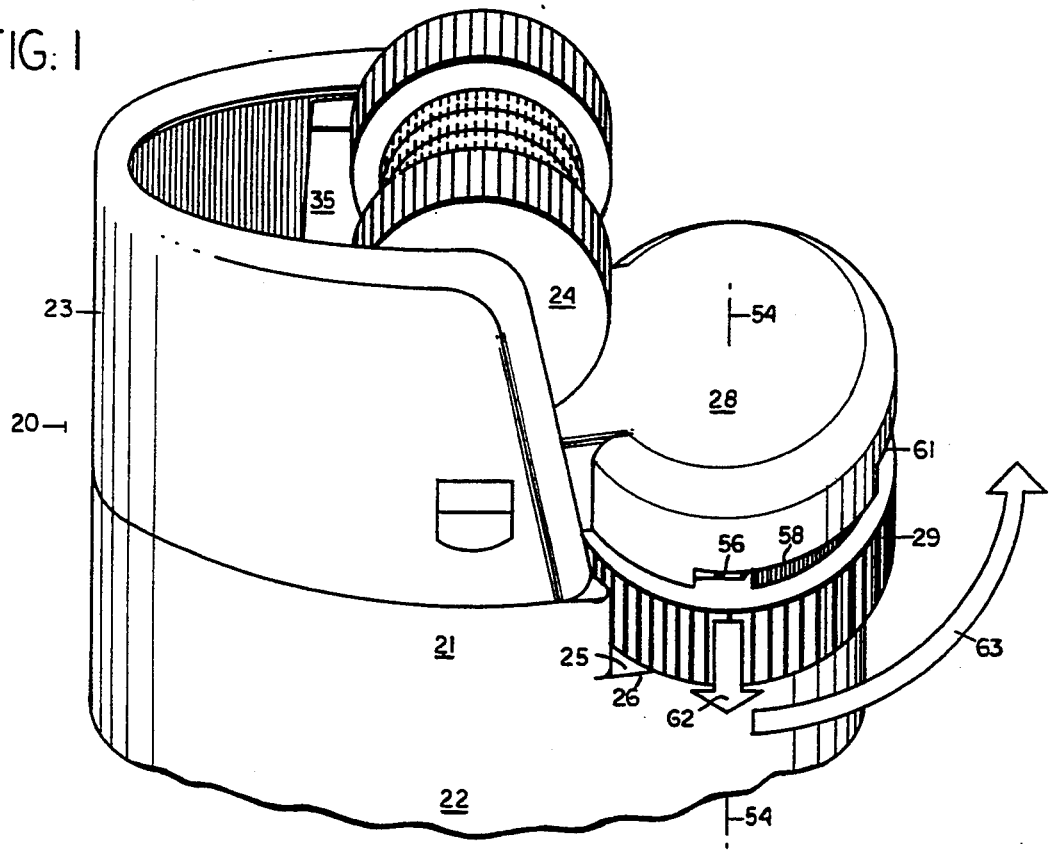
FIG. 1 is a general view in perspective of the broken-away upper portion of an otherwise conventional disposable lighter that has been modified to make it child-resistant lighter according to the present invention. The conventional counterpart of this embodiment has a valve/pushbutton biasing spring mounted under its pushbutton. In the illustrated child-resistant version, a cylindrical safety release member is seen mounted under the pushbutton to normally block its depression and, in place of the conventional spring, a safety release biasing spring, concealed in FIG. 1 but seen in FIG. 3, is mounted between the safety release and the pushbutton and does double-duty as a valve/pushbutton biasing spring. The pushbutton is configured to require a multiple-step mode of operation of the safety release as indicated by the arrows.

The flintwheel type of disposable lighter being lowest in cost is in widest use and most likely to be left lying about, and consequently, most often implicated in fires caused by children playing with lighters. Accordingly, the need is greatest to make the flintwheel type of disposable lighter child-resistant, and so, in the accompanying drawings the invention is shown embodied in that type of lighter.

As is well-known, the flintwheel type of disposable lighter comprises a housing defining a fuel compartment containing a combustible fluid under pressure, valve means communicating with the fuel compartment—the valve means including a vertically movable nozzle element, a pivotally mounted lever one end of which is engaged with the nozzle element and the opposite end of which forms a thumb-depressible pushbutton, a flint mounted under a wheel that is rollable to abrade the flint simultaneously with depression of the pushbutton, and a single spring (herein termed a "valve/pushbutton biasing spring") that biases the nozzle element downwardly to a normally closed position and simultaneously biases the pushbutton upwardly whereby the pushbutton is maintained at a given normal elevation above a given upper end portion of the housing and is depressible from such given normal elevation against the resistance of the valve/pushbutton biasing spring. Depression of the pushbutton lifts the nozzle element to an open position, causing escape of the combustible fluid which is released in a gaseous state and ignited by sparks which are generated by the flint as the flintwheel is rolled.

Conventionally, such lighters differ with respect to the specific location of the valve/pushbutton biasing spring.

Type 1 Lighter

In one form of such lighter, the valve/pushbutton biasing spring is located under the pushbutton to bias it upwardly whereby the forward end of the lever holds the nozzle element pressed downwardly into its normally closed position. A flintwheel type of disposable lighter having its valve/pushbutton biasing spring located under its pushbutton is herein termed a "Type 1 lighter".

Type 2 Lighter

In another form of flintwheel type of disposable lighter, the valve/pushbutton biasing spring is located within the valve mechanism to bias the nozzle element downwardly whereby the pushbutton, being at the opposite end of the lever, is biased upwardly. A flintwheel type of disposable lighter having its valve/pushbutton biasing spring located in its valve mechanism is herein termed a "Type 2 lighter".

Conventionally, Type 1 and Type 2 lighters differ also with respect to the form in which the lighter's fuel compartment is molded. The Type 1 lighter's fuel compartment (at least at the present time) is molded essentially in the form of an inverted cup (i.e., initially open at the bottom and later closed by a bottom plug). The Type 2 lighter's fuel compartment (at least at the present time) is molded essentially in the form of an upright cup (i.e., initially open at the top and later closed by a top plug).

One object of the invention is, and the accompanying drawings show, how the invention child-resistance-effecting structure can economically be incorporated in either a Type 1 or a Type 2 lighter. Accordingly, the drawings reflect the specific differences in construction which are peculiar to each type of lighter but which particulars are essentially unrelated to the invention itself; however, specifically different embodiments of the invention are presented as best suited for incorporation in each type of lighter with least possible modification of the conventional form of such lighter.

Conveniently for present purposes, the above-referred-to Type 1 and Type 2 lighters are easily distinguishable in the accompanying drawings by their characteristically different styling: since only one manufacturer makes a Type 1 lighter and has given it a generally elliptical shape, it is identifiable on sight from all others making the Type 2 construction since all have given their product a generally rectangular shape.

Accordingly, the reader will immediately recognize FIG. 1 of the accompanying drawings as being a "BIC" brand of lighter ("BIC Corporation") as it might appear if it were modified to incorporate the present invention. For present purposes, however, the embodiment seen in FIG. 1 shall be understood to represent merely one possible mode of incorporation of the invention in a Type 1 current lighter product; i.e., any flintwheel type of lighter that has its valve/pushbutton biasing spring located under its pushbutton.

Figure 16:
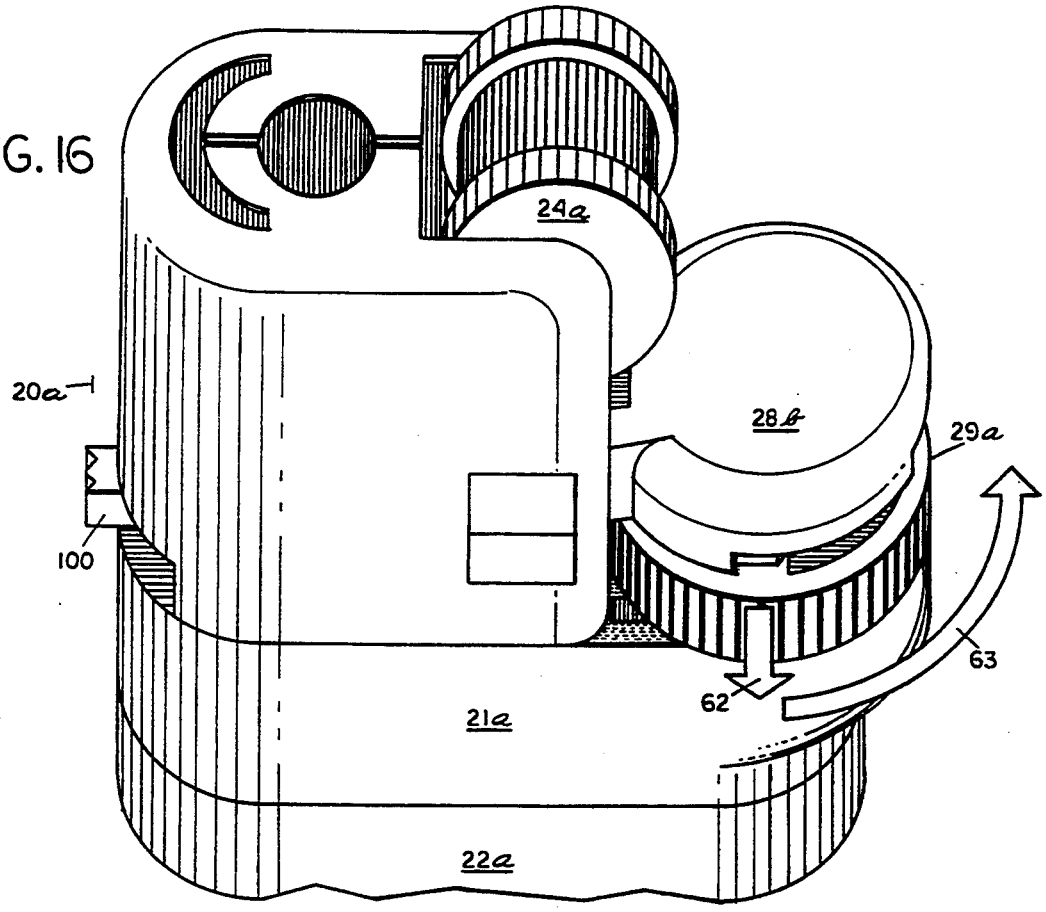
FIG. 16 is a general view in perspective of the broken-away upper portion of an otherwise conventional disposable lighter that has been modified to make it child-resistant lighter according to the present invention, but which differs from that of the FIG. 1 lighter in that, the conventional counterpart of this embodiment has a valve/pushbutton biasing spring that is incorporated within its valve mechanism. In the illustrated child-resistant version, a cylindrical safety release member is seen mounted under the pushbutton to normally block its depression. The arrows indicate that the multiple-step mode of operation of the safety release is identical to that of the FIG. 1 embodiment. The safety release biasing spring added by the invention could, in the FIG. 16 embodiment, be mounted on top of the safety release as it is in the case of the FIG. 1 embodiment, but, since it is not needed in the FIG. 16 embodiment to function simultaneously as a valve/pushbutton biasing spring, the FIG. 16 embodiment presents an opportunity to illustrate an alternative arrangement of the safety release biasing spring. In a conventional disposable lighter product of the type illustrated in FIG. 16 the safety release biasing spring can be mounted under the safety release as shown in FIG. 18.

Similarly, FIG. 16 of the accompanying drawings, although not necessarily faithfully replicating a given brand of disposable lighter product, is readily recognizable as representing any one of a number of well-known and lesser well-known brands of such product. For present purposes, the embodiment seen in FIG. 16 shall be understood to represent merely one possible mode of incorporation of the invention in a Type 2 current lighter product; i.e., any flintwheel type of lighter that has its valve/pushbutton biasing spring located in its valve mechanism.

Another object of the invention relates more directly to the invention itself, and the accompanying drawings show, two specifically different multiple-step modes of operation, a first as simple as possible in order to maximize adult convenience and thereby attain widest consumer acceptance, but, as a safeguard or recourse in the event market experience suggests that greater emphasis should be given to child-resistancy, a second type of multiple-step mode of operation is disclosed that is calculated to confound a greater percentage of children in the pertinent age group.

Still another object of the invention is, and the accompanying drawings show, how a given current (Type 1 or Type 2) lighter product, if initially modified as disclosed herein, can economically and substantially without production "down time" easily be enhanced (converted from the first type to the second type of multiple-step mode of operation) merely by substituting one pushbutton for another.

Type 1; "Press and Turn"

Figure 2:
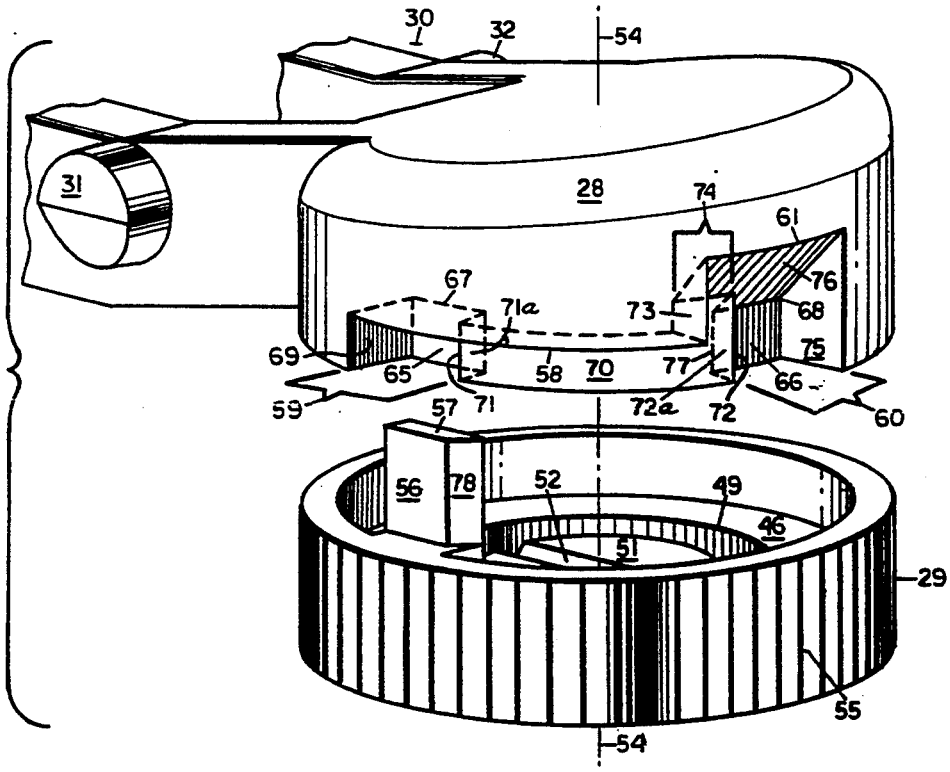
FIG. 2 is an enlarged perspective view of the pushbutton of FIG. 1 broken away from the pivotally mounted lever of which is forms a part, and of the cylindrical safety release, in exploded relationship, and minus the safety release biasing spring referred to above.
Figure 3:
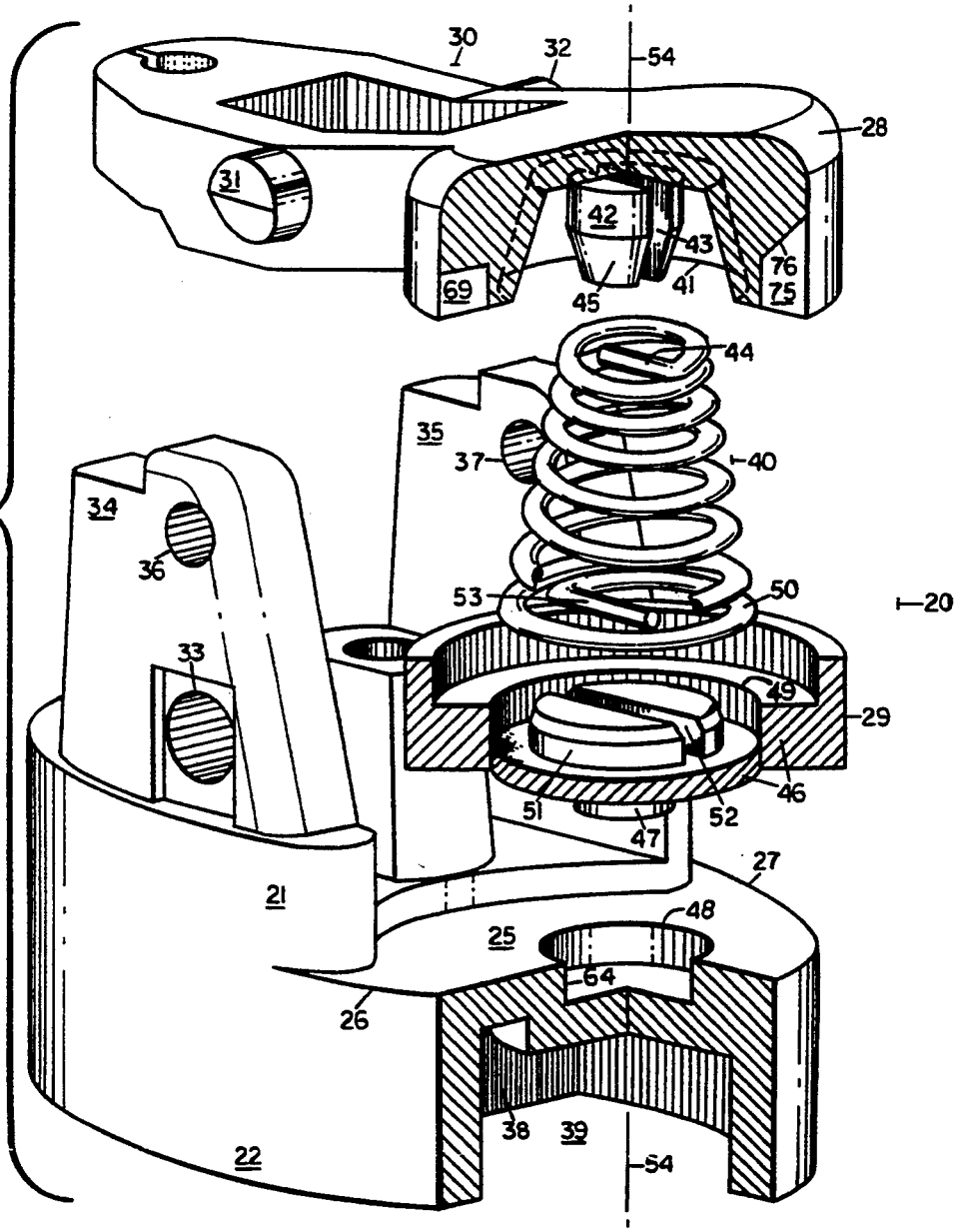
FIG. 3 is an exploded perspective view of only those components of the FIG. 1 embodiment which are pertinent to the present invention, comprising, from top to bottom, the entirety of the lever of which the pushbutton forms a part, a conical helical safety release biasing spring, the cylindrical safety release and the upper end portion of the lighter's housing—all of these components except for the spring being shown partly in section.
Figure 4:
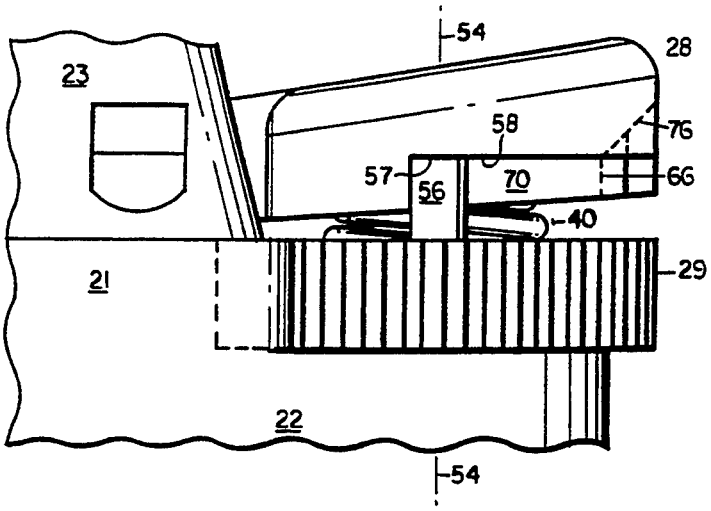
FIG. 4 is a fragmentary side elevational view of the structure of FIG. 3 shown in assembled relationship. The probe member of the safety release is seen at its rest position abutting a planar undersurface of the pushbutton whereby the pushbutton is normally blocked against depression.
Figure 5:
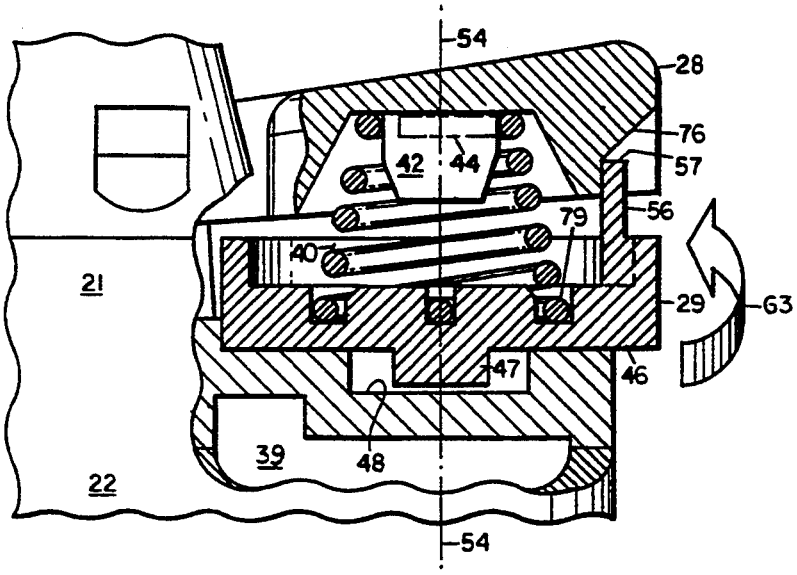
FIG. 5 is a view similar to FIG. 4 except partly in section, showing the probe of the safety release rotated 90 degrees from the position in which it is represented in FIG. 4 and standing now at its alternate position under a wedge surface of the pushbutton.
Figure 6:
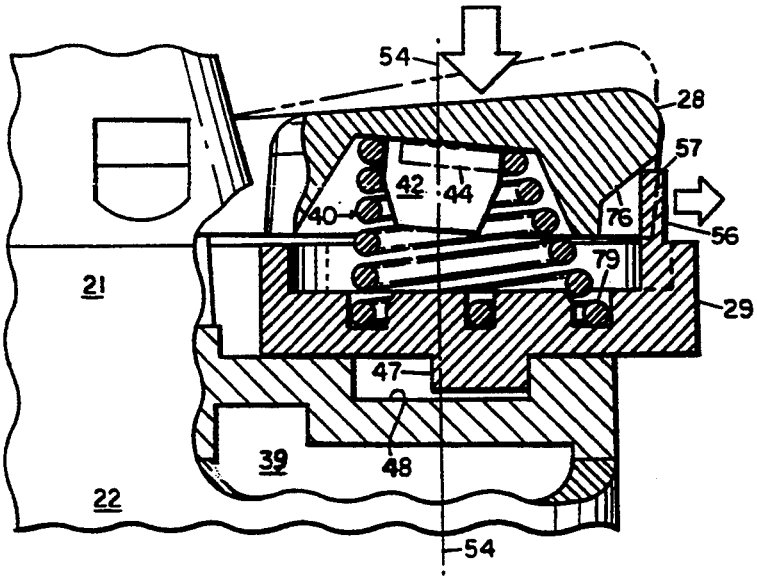
FIG. 6 is a view similar to FIG. 5 showing the pushbutton is depressed position whereby the wedge surface was lowered and has forced the probe outwardly. The safety release is seen having slid horizontally toward the right compared with its position in FIG. 4 and in FIG. 5.

FIG. 1 of the accompanying drawings represents (a) a Type 1 current lighter product, (b) having the invention incorporated therein, (c) in a form having a first type of multiple-step mode of operation. As indicated by the arrows, the FIG. 1 embodiment has what might be termed a "Press and Turn" unlocking feature-not too dissimilar from what is already familiar to consumers in connection with child-resistance packaging. FIGS. 2–11 are all related to the FIG. 1 embodiment, FIG. 2 showing the configuration of the pushbutton and safety release, FIG. 3 showing the order of assembly with other elements, FIGS. 4–6 showing all elements finally assembled and in certain phases of operation, and FIGS. 7–11 showing the operating sequence that effects the "Press and Turn" action.

Type 1; "Double Twist"

Figure 12:
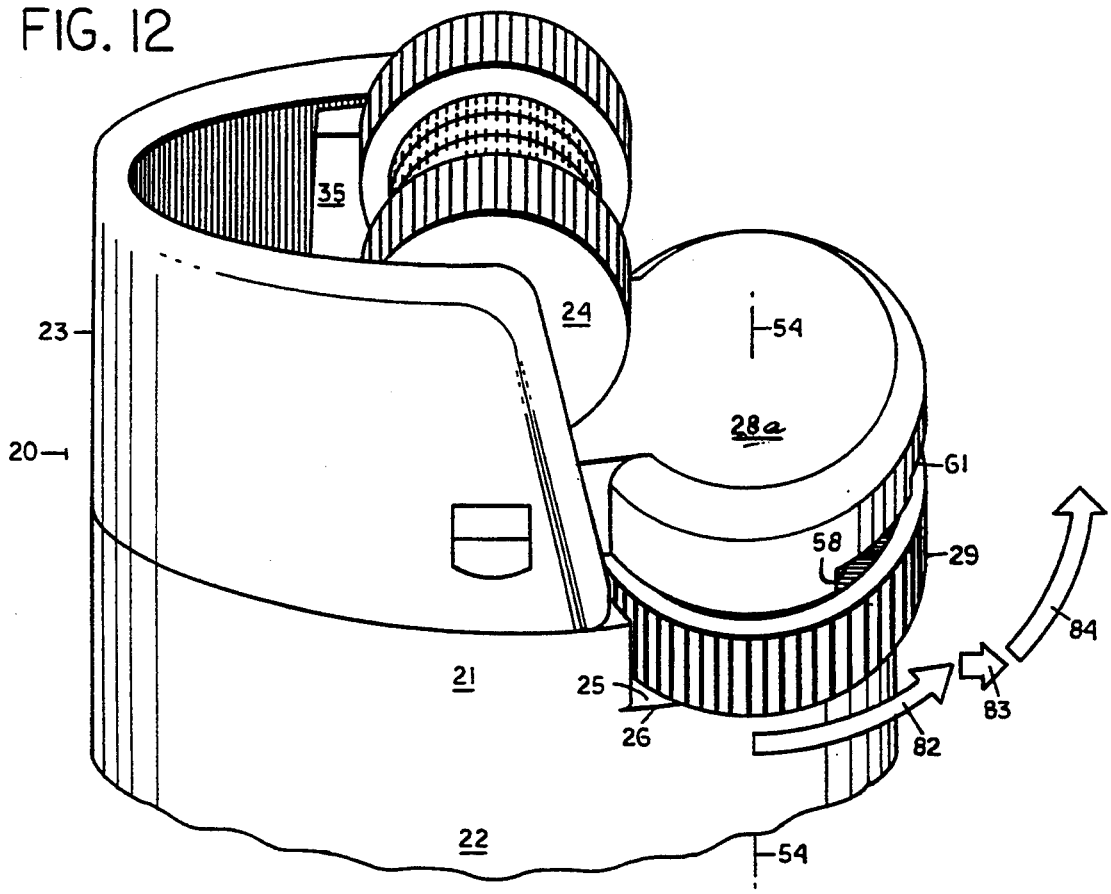
FIG. 12 is a general view in perspective of a second embodiment that is identical in all respects to FIG. 1 except that a pushbutton of specifically different underside configuration has been substituted for the pushbutton employed in the FIG. 1 embodiment. The result of this substitution is that a new multiple-step mode of operation of the safety release is required that is more sophisticated than that of the first embodiment. This permits enhancement of the product at minimal cost in the event experience proves same desirable.
Figure 13:
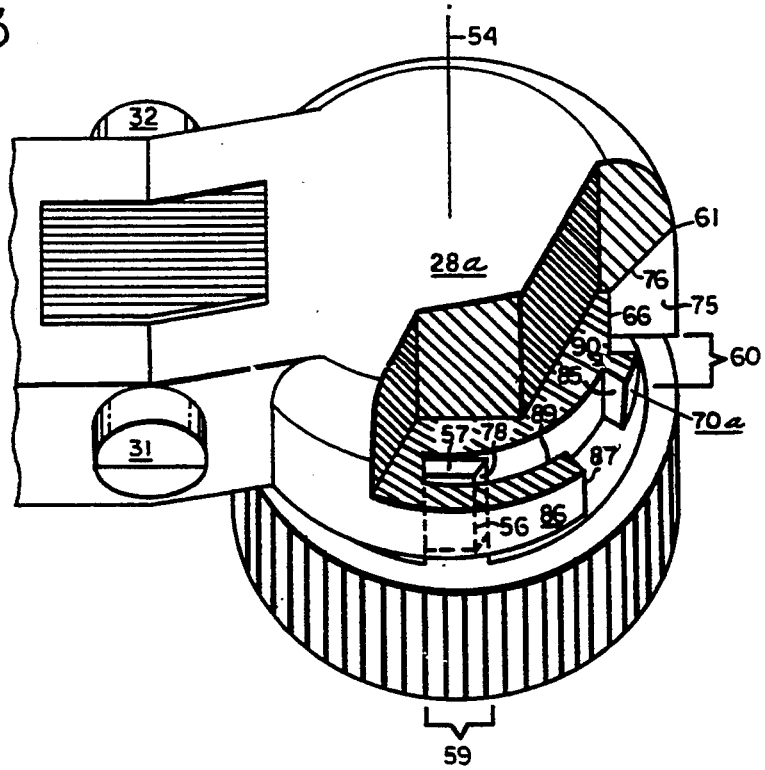
FIG. 13 is an enlarged perspective of the pushbutton of FIG. 12 sectioned to show the different configuration thereof, and with the safety release in initial position whereby the probe is located at its rest position.
Figure 14:
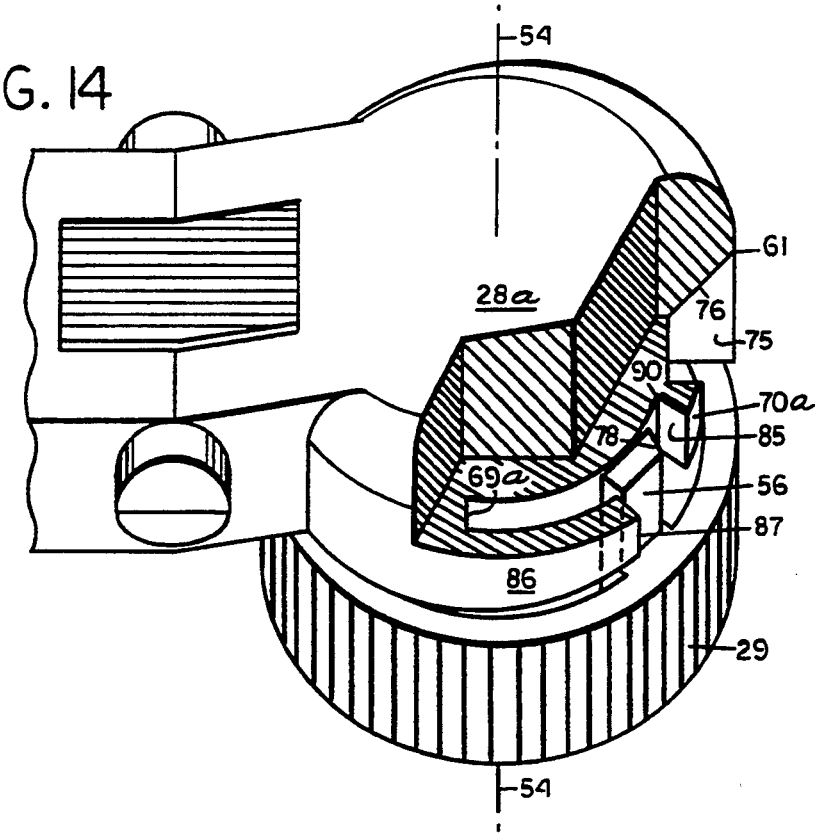
FIGS. 14 and 15 are similar to FIG. 13 and show successive phases of the multiple-step mode of operation of the FIG. 12 embodiment of pushbutton. Specifically.
Figure 15:
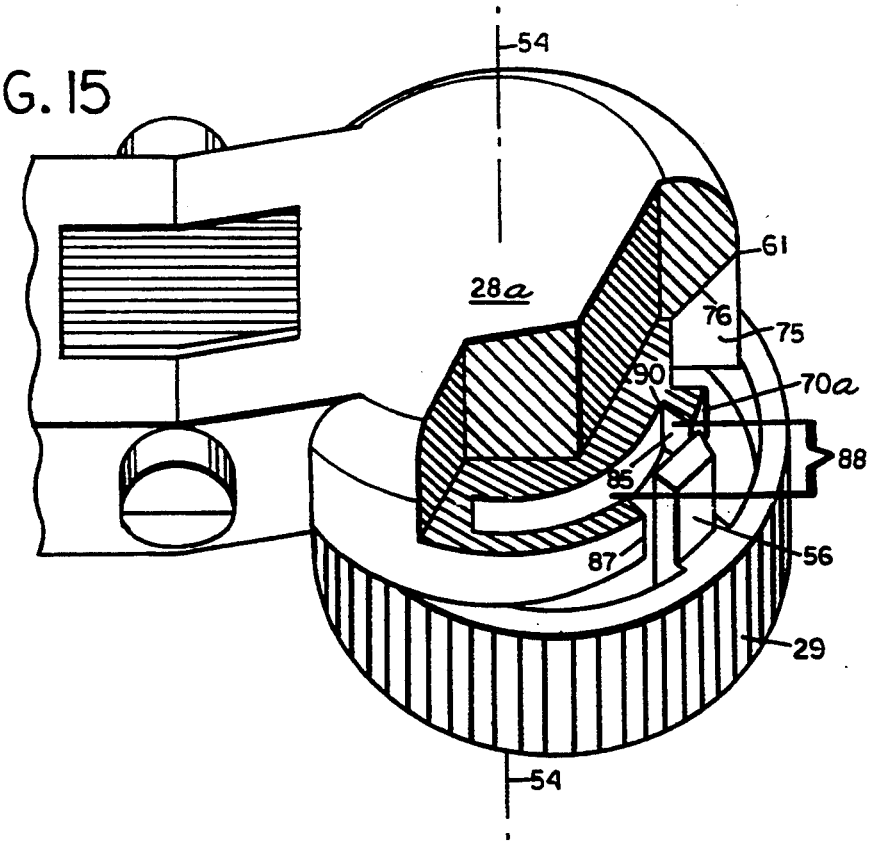

FIG. 12 shows the same lighter as seen in FIG. 1 except that a different pushbutton has replaced the one used in the FIG. 1 embodiment. Nothing else has been changed. The result of this substitution is that the FIG. 12 embodiment has a different multiple-step mode of operation. As indicated by the arrows, the FIG. 12 embodiment has what might be termed a "Double Twist" unlocking feature, with a very subtle pull of the safety release effected between the two rotations of it. FIGS. 13–15 are all related to the FIG. 12 embodiment, showing the configuration and operation of the substitute pushbutton by means of which the "Double Twist" action is given effect.

Likewise, the Type 2 lighter is also convertible from a "Press and Turn" to a "Double Twist" multiple-step mode of operation merely by substituting one pushbutton for another.

Type 2; "Press and Turn"

Figure 17:
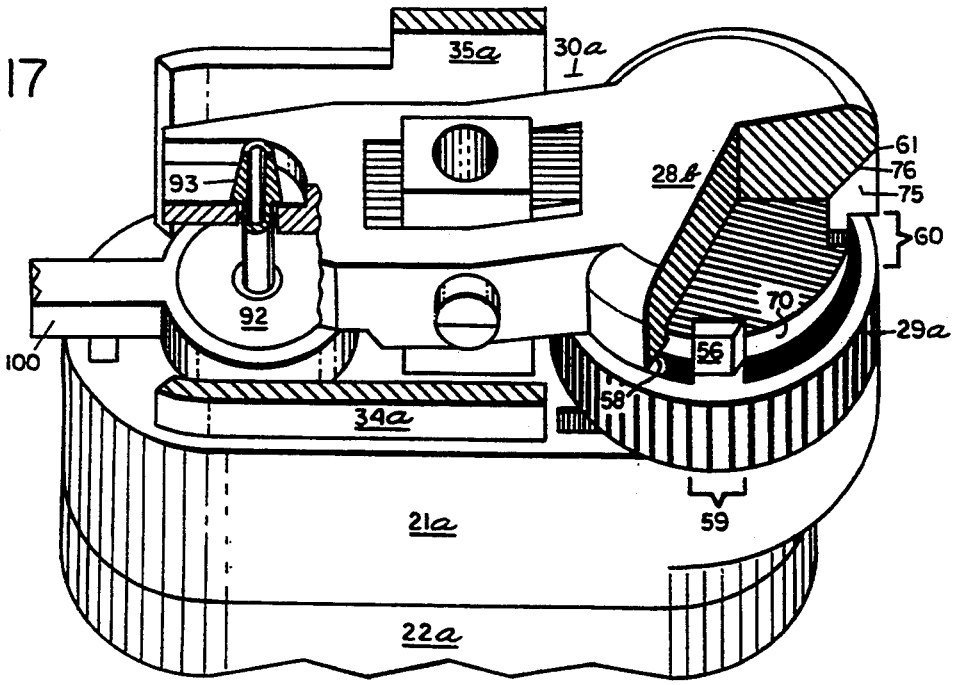
FIG. 17 is a partly disassembled view of the FIG. 16 embodiment showing that, except for differences related to the different location of the safety release biasing spring, the pushbutton of the FIG. 16 embodiment has a configuration like that of the FIG. 1 embodiment.
Figure 18:
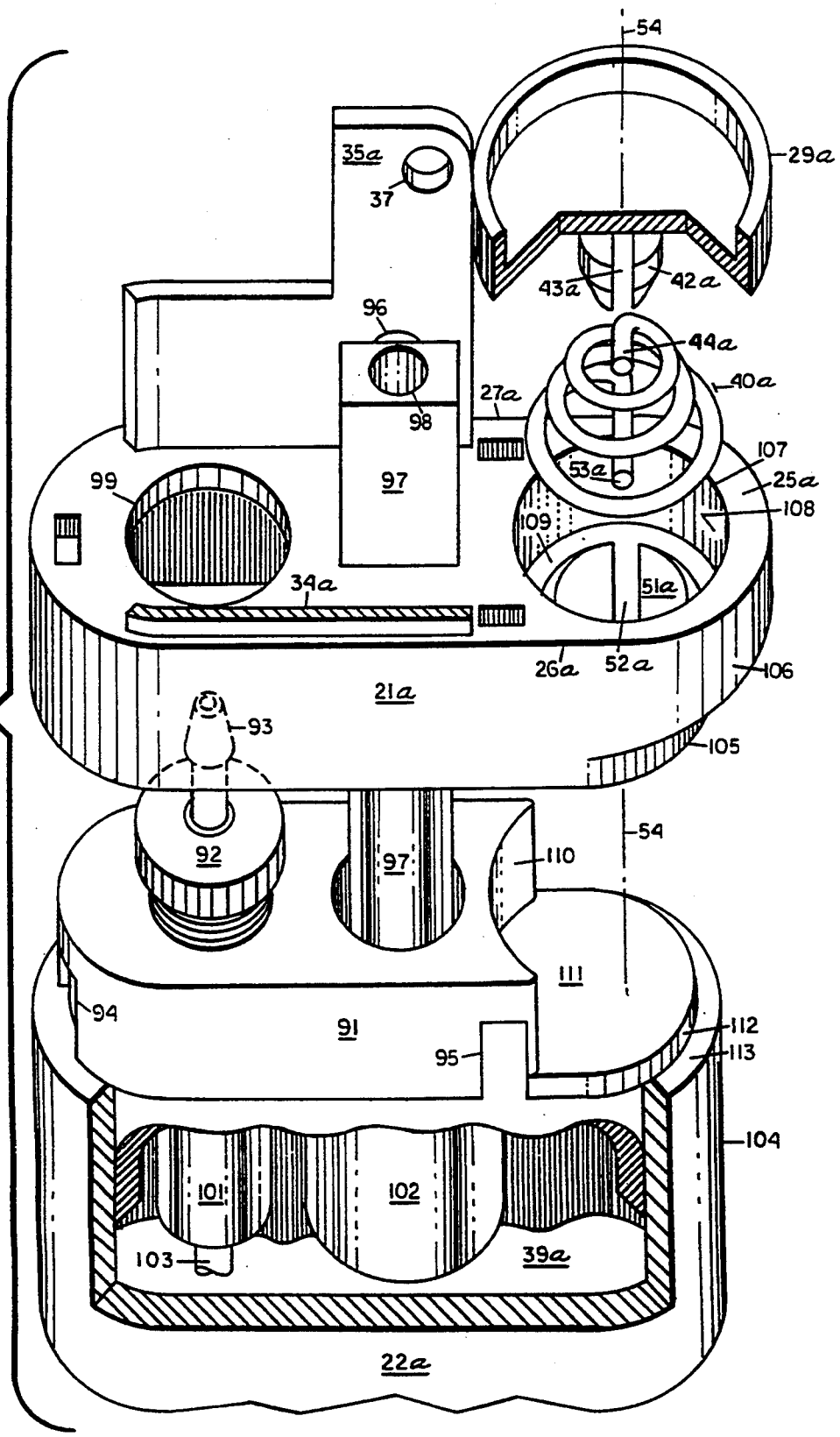
FIG. 18 is an exploded perspective view of pertinent parts of the FIG. 17 embodiment, but without its pushbutton.

FIG. 16 of the accompanying drawings represents (a) a Type 2 current lighter product, (b) having the invention incorporated therein, (c) in a form, as indicated by the arrows, having the same "Press and Turn" action provided for the Type 1 lighter. FIGS. 17 and 18 are related to the FIG. 16 embodiment, FIG. 17 establishing that, with respect to that portion of the pushbutton that effects the "Press and Turn" action, the pushbutton used in the Type 2 lighter is identical to that used in the Type 1 lighter, and FIG. 18 showing the order of assembly of certain elements.

Type 2; "Double Twist"

Not shown because obvious in view of the other drawings. To avoid unnecessary repetition of text and duplication of drawing figures, in the accompanying drawings, the Type 2 lighter is not shown with the pushbutton that effects the "Double Twist" action because obvious in view of FIG. 17 which shows the general construction of the pushbutton used in the Type 2 lighter, FIGS. 13–15 which show the configuration that effects the "Double Twist" action and how it operates, and FIG. 12 which shows the arrows that describe the "Double Twist" action.

DETAILED DESCRIPTION OF TYPE 1 CHILD-RESISTANCE LIGHTER

Referring to FIG. 1, there is seen a Type 1 current lighter product comprising a housing indicated generally as 20 having a vertically elongate main body portion but only the upper end portion 21 of which housing 20 is seen in entirety, the greater part of the main body portion 22 of the housing 20 having been broken away. Familiar visible elements mounted on the upper end portion 21 include a windscreen 23 and flintwheel 24. The invention provides the upper end portion 21 modified from the conventional product to the extent of defining a horizontal top wall 25, FIGS. 1 and 3, having opposed free edges 26, 27 (the conventional product also has a horizontal top wall but not with free edges but instead surrounded by upright wall structure that forms part of the upper end portion 21). As is well known, conventionally, such lighter includes a pivotally mounted lever the rearward end of which defines a pushbutton the shape of which conforms to the generally elliptical shape of the lighter's body. The invention modifies only the pushbutton end of such lever. Specifically, the invention provides a preferably cylindrically shaped pushbutton 28 and a cylindrical safety release 29 mounted on the top wall 25 under the pushbutton 28.

Skipping FIG. 2 for the moment and referring to FIG. 3 for further description of the setting for the portion improved upon, the pushbutton 28 forms the rearward end of a lever indicated generally as 30 that conventionally includes a pair of opposed pivots 31, 32, that, when the lever is installed, are received in a corresponding pair of openings, one of which is seen at 33, which openings are provided in a pair of parallel spaced apart tabs 34, 35, which extend upwardly from the upper end portion 21. Similarly, the flintwheel 24 includes an opposed pair of pivots (not shown) which are received in a corresponding pair of openings 36, 37; assembly of the lever 30 and flintwheel 24 being effected by forcibly pressing them downwardly between the tabs 34, 35, which flex apart just enough to permit a snapped into place mode of assembly—all of which is well-known in the art. A sectioned-away corner of the main body portion 22 affords a view into the interior thereof. The structure seen at 38 is the conventionally-provided partition that partially divides the fuel compartment into two equal size parts only one half of which is seen at 39. Conventionally, the Type I lighter includes a valve/pushbutton biasing spring that is in the form of a compressible helical spring having coils of uniform diameter, mounted between the conventional pushbutton and top wall; specifically, with an upper end portion of such spring extending into a recess that is provided in the underside of the conventional pushbutton and with a lower end portion of such spring standing in a recess that is provided in the top wall.

The invention replaces the conventional valve/pushbutton biasing spring with a conical helical "safety release biasing spring 40" mounted extending between the pushbutton 28 and the safety release 29. The underside of the pushbutton 28 is provided with an oversized recess 41 into which the upper end of the safety release biasing spring 40 is received but which will permit horizontal displacement of the lower end of the spring. More particularly, the recess 41 is provided with a first split boss 42 that provides a notch 43 for receipt of the upper end 44 of the safety release biasing spring 40, the first split boss 42 preferably having its free end 45 tapered to facilitate entry into the upper end of the safety release biasing spring 40. The upper end of the safety release biasing spring 40 is thereby nonrotatably secured to the pushbutton 28. The top coil of the safety release biasing spring 40 should fit as closely as practicable around the first boss 42.

Still referring to FIG. 3, the safety release 29 includes a base 46 that is slidable on the top wall 25. A pivot 47 depends from the underside of the base 46. The top wall 25 is provided with a recess 48 that is large enough (as measured horizontally) to permit the safety release 29 to slide about on the top wall 25 but not slide so far that the base 46 would not be sufficiently supported by the top wall 25. The top wall recess 48 is shown having a circular shape, but any shape will do that will serve the purpose of permitting the safety release 29 to be moved about on the top wall 25 as necessary to implement the desired multiple directions of movement of the safety release 29.

The upper side of the safety release 29 is provided with a circular recess 49 having a diameter corresponding to that of the bottom coil 50 of the safety release biasing spring 40 so that any direction of horizontal displacement of the safety release 29 will necessarily likewise displace the bottom coil 50. A second split boss 51 rising from the bottom of the recess 49 provides a notch 52 that receives the lower end 53 of the safety release biasing spring 40. The lower end of the safety release biasing spring 40 is thereby nonrotatably secured to the safety release 29.

Accordingly, in this mounting of the safety release biasing spring 40, it is positioned to do "double-duty" as a valve/pushbutton biasing spring in place of the conventional valve/pushbutton biasing spring which the safety release biasing spring 40 has replaced; i.e., when the lever 30 is in its finally assembled position, the safety release biasing spring 40 will be in partial compression whereby the nozzle element (not shown) of the lighter's valve mechanism (not shown) will be firmly biased normally closed, and, at the same time, the pushbutton 28 will be biased upwardly toward a given normal elevation. Depression of the pushbutton 28 will further partially compress, and thereby be effected against the resistance of, safety release biasing spring 40.

The first split boss 42 and the top wall recess 48 are concentrically aligned with a common vertical axis 54 (only upper and lower end portions of which are seen in FIG. 3). Since the first split boss 42 of the pushbutton 28 is, for all practical purposes, movable only along vertical axis 54 and is fixed in position as far as any significant movement in a horizontal plane away from vertical axis 54 is concerned, the pushbutton 28 determines the normal position or concentric alignment of the safety release biasing spring 40 with respect to vertical axis 54—the pivot 47 of the safety release 29 having sufficient freedom of horizontal movement within the top wall recess 48 to permit the base 46 of the safety release 29 to slide on the top wall 25 and thereby permit the lower portion of the safety release biasing spring 40 to both initially concentrically align itself about vertical axis 54 and, whenever horizontally displaced therefrom, to seek return to such concentric alignment.

Rotation of the safety release 29 necessarily effects corresponding rotation of the bottom coil of the safety release biasing spring 40 because its lower end 53 is not rotatable relative to the safety release 29. But, any rotation of the safety release 29 in a direction about vertical axis 54 that causes the bottom coil (and thereby in successively lesser degrees, the intermediately coils) of the safety release biasing spring 40 to wind tighter will be yieldably resisted because the top coil of the safety release biasing spring 40 is not rotatable relative to pushbutton 28 (because the upper end 44 of the safety release biasing spring 40 is retained in the notch 43 of the first split boss 42).

Accordingly, the safety release 29 is normally centered under the pushbutton 28, and, is movable both rotationally about and also horizontally away from the vertical axis 54, and, when forcibly displaced either rotationally or horizontally away from a given initial position will acquire a corresponding rotational or horizontal return bias, as the case may be, to return to its initial position.

Referring now to FIG. 2 which affords a general view of the safety release 29, all of the above-described aspects of the safety release 29 are visible in FIG. 2 except for the pivot 47, which aspects include the upper surface of its base 46, the recess 49 that receives the bottom coil of the safety release biasing spring 40, and the second split boss 51 with its notch 52 that nonrotatably secures the bottom coil. The safety release 29 has a cylindrical outer wall surface that is preferably provided with numerous vertical grooves as indicated at 55 to facilitate obtaining a positive grasp of the safety release 29 between thumb and forefinger to effect forcible rotation or horizontal movement of it against the corresponding resistances of the safety release biasing spring 40. More particularly, the safety release 29 includes a probe member 56 having a free end 57 which, by rotation of the safety release 29, is rotatable about the vertical axis 54.

In all embodiments of the pushbutton 28, at least a portion of its underside is shaped to define a horizontal planar undersurface 58 (in prior disclosures termed a "low ceiling"), and, when finally assembled in cooperative relationship with the safety release 29, the free end 57 of the probe 56 is in movable abutment against the undersurface 58 and thereby normally blocks depression of the pushbutton 28.

In all embodiments of the pushbutton 28, the probe 56 has a given initial or rest position 59 and a given alternate position 60. No matter where the probe 56 is moved under the undersurface 58, so long as the free end 57 of the probe 56 stands under any part of the undersurface 58 the pushbutton 28 will be blocked against depression. However, at the probe's alternate position 60, the undersurface 58 is effectively elevated to provide a clearance 61 (in prior disclosures termed a "high ceiling segment" of the "low ceiling") over the probe 56 that is sufficient to permit the pushbutton 28 to be depressed. The user must move the probe 56 from its rest position 59 to its alternate position 60 in order to render the pushbutton 28 depressible. But, in all embodiments of the pushbutton 28, wall structure extending between the probe's rest and alternate positions prevents movement of the probe in certain directions and permits movement of the probe only in certain other directions. The specific arrangement of such wall structure determines how the safety release 29 must be manipulated in order to cause the probe 56 to travel from its rest position 59 to its alternate position 60. The specific configuration of the pushbutton 28 is thereby determinative of the multiple-step mode of manipulation of the safety release 29.

"Press and Turn" Mode of Operation

In the embodiment shown in FIG. 2, the pushbutton 28 has an arrangement of its wall structure that requires the user to effect a "Press and Turn" manipulation of the safety release 29 in order to render the pushbutton 28 depressible. The "Press" part of this manipulation refers to a horizontal movement of the safety release 29 away from the vertical axis 54; e.g., as indicated by arrow 62 in FIG. 1. The "Turn" part of this manipulation refers to a rotational movement of the safety release 29 about the vertical axis 54; e.g., as indicated by arrow 63 in FIG. 1. Of course, the top wall recess 48, FIG. 3, is proportioned (as measured in a horizontal plane) such that, by abutment of the pivot 47 against the inside wall 64 of the top wall recess 48, the probe 56 can never be moved outboardly so far that its free end 57 goes beyond the undersurface 58. The arrangement is such that the only way to render the pushbutton depressible is to rotate the probe 56 to its alternate position 60.

In the configuration shown in FIG. 2, wall segments 65, 66, are at the same distance from the vertical axis 54. The upper edge 67 of wall segment 65 and the upper edge 68 of wall segment 66 are both located in the same horizontal plane as undersurface 58.

The probe 56 stands normally against wall segment 65 with the free end 57 of probe 56 abutting the overhanging area of undersurface 58 and thereby preventing depression of the pushbutton 28.

Wall segment 69, FIG. 2, prevents rotation of the probe 56 in a direction opposite to that indicated by arrow 63 of FIG. 1, and thereby prevents rotation of the safety release 29 in a direction that would end to unwind the coils of the safety release biasing spring 40.

Wall segment 70 is located further from vertical axis 54 than are wall segments 65, 66, by an amount substantially equal to the thickness of probe 56 as measured between the inboard and outboard upright surfaces thereof. The wall segments at 69, 65 and 71*a* collectively define a first notch within which the probe 56 is normally located when at its rest position 59. The probe 56 must be pulled (in the direction indicated by arrow 62, FIG. 1) beyond the corner 71 of wall segment 70 before it will be possible to rotate the probe 56 in the direction indicated by arrow 63, FIG. 1. When the probe 56 is pulled far enough to clear the corner 71, the probe's free end 57 will still be located under the undersurface 58 because the outer border of undersurface 58 (being pointed to by numeral 58) is located at a still greater radial distance from vertical axis 54 (as compared with wall segment 70). Evidently, the only direction in which it will be possible to move probe 56 once it has been pulled clear of corner 71 is rotationally in the direction indicated by arrow 63 of FIG. 1.

Wall segment 70 extends arcuately between rest position 59 and alternate position 60 at a uniform radius from vertical axis 54; wall segment 70 begins at corner 71 and ends at corner 72.

The clearance 61 creates an "undersurface end wall 73" that results in a portion 74 of wall segment 70 extending upwardly above the elevation of the plane in which undersurface 58 lies; the relatively taller portion 74 being located within the area of clearance 61.

The clearance 61 also creates a stop wall 75 that will stop rotation of safety release 29 when the probe 56 has reached its alternate position 60. The user thereby knows by "feel" when the probe 56 has been moved to the correct position. The user simply rotates the safety release 29 until he can rotate it no further.

A wedge surface 76 extends laterally between undersurface end wall 73 and stop wall 75 and is thereby coextensive with the width of clearance 61, and extends upwardly at an inclination from the edge 68 of wall segment 66 to the clearance 61.

The intersection between wall segment 66 and wall segment 72*a* forms an inside corner 77 that is located in the probe's return bias path from its alternate position 60 to its rest position 59.

Finally, the probe 56 is preferably formed having a sharp-cornered bevel 78. The bevel 78 is not needed for this "Press and Turn" embodiment; it is provided only so that the safety release 29 can be used also in combination with the alternative "Double Twist" version of pushbutton 28.

Referring now to FIG. 4, which shows the structure of FIG. 2 as finally assembled with the structure of FIG. 3, the probe 56 is seen at its rest position having its free end 57 abutting the undersurface 58 whereby the pushbutton is normally blocked against depression. The probe 56 is located substantially flush with wall segment 70. The safety release biasing spring 40 is in partial compression whereby the pushbutton 28 is biased upwardly but is not under rotational or horizontal distortion.

In FIG. 5, safety release 29 has already been pulled as indicated by arrow 62 of FIG. 1 and has also been rotated as indicated by arrow 63 of FIG. 1, as a result of which, probe 56 has, in FIG. 5, been rotated 90 degrees from the position in which it is represented in FIG. 4. Probe 56 is now standing at its alternate position 60 (FIG. 2) against wall segment 66 (FIG. 22) with the free end 57 of probe 56 at the lower edge of wedge surface 76, FIG. 5. The upper end 44 of the safety release biasing spring 40 is seen nonrotatably secured in notch 43, and the lower end 53 of the safety release biasing spring 40 is seen nonrotatably secured in notch 53. Rotation of the safety release 29 has wound its bottom coil 79 tighter and as a result the probe 56 is at this time under a rotational return bias. The probe 56 is not at this time biased to move toward the vertical axis 54 because all the coils of the safety release biasing spring 40 are concentrically aligned with vertical axis 54.

In FIG. 6, however, the pushbutton 28 has been depressed, and as a result, the wedge surface 76 was lowered and has forced the probe 56 outwardly. The safety release 29 is seen having been forced to slide horizontally toward the right compared with its position in FIGS. 4 and 5. The horizontal movement of safety release 29 has pulled the bottom coil 79 of safety release biasing spring 40 out of concentric alignment with its upper coils and this has added a horizontal return bias (i.e., back toward vertical axis 54) to the already existing rotational return bias.

Referring now to FIGS. 7–11 (but looking to FIG. 2 for any reference number mentioned below not found in FIGS. 7–11), FIG. 7, like FIG. 1 and also FIG. 4, shows the safety release 29 in its initial position whereby the probe 56 is located at its rest position 59. The bevel 78 makes it appear that the probe 56 is not fully within the first notch but this is merely an illusion; the outboard surface of probe 56 is in fact flush with wall segment 70. The safety release biasing spring 40 is under no stress except for partial compression along the vertical axis 54. The safety release 29 cannot be rotated because wall segment 71*a* prevents rotational movement of the probe 56. The probe 56 must be pulled clear of corner 71 before the probe 56 can be rotated.

Figure 8:
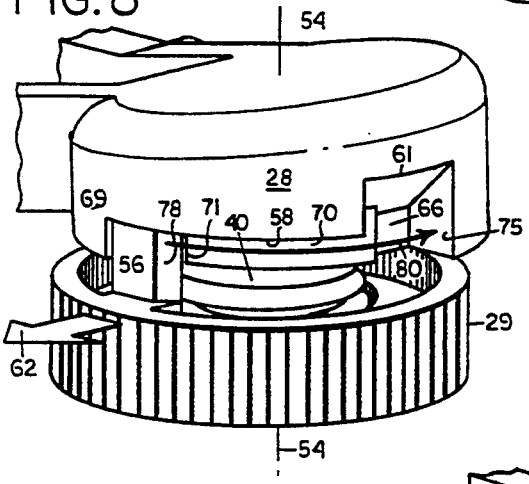

Assuming right-handed user operation, in FIG. 8 the user has pulled the probe 56 clear of corner 71 by pressing the far side of safety release 29 with his forefinger. The pivot 47 (FIG. 3), by interference with the side wall 64 of the top wall recess 48, prevents movement of the probe 56 beyond undersurface 58—note that a little bit of wall segment 69 still visible. Accordingly, the user does not have to exercise any manipulative skill; he simply presses the safety release 29 hard as far as it will go.

Fail-Safe Multiple-Step Action

The probe 56 is still standing under the undersurface 58, and so, the pushbutton 28 still cannot be depressed. Therefore, if a child effects this first step of operation, he still will not have unlocked the pushbutton 28. Further, there is no way that the child, even by using both hands, can possibly avoid having to first fully implement this first step. Even if the child were applying continuous downward pressure to the pushbutton 28 while pressing the safety release 29 in the direction of arrow 62, the pushbutton 28 will remain locked because the probe 56 is still under the undersurface 58.

The safety release 29 is now rotatable, but in only one direction, toward the right—rotation toward the left being prevented by wall segment 69. The wire from which the safety release biasing spring 40 is made has a gauge thick enough and is tempered to produce a spring that strongly resists any displacement of its bottom coil away from its normal alignment. This resistivity does not adversely impact on depressibility of the pushbutton 28 because the spring is made having a sufficient number of coils to permit useful compression and such a coil spring is inherently easier to compress than it is to twist one end relative to the other end. Moreover, to the extent, if any, that such resistive spring may make the pushbutton 28 somewhat firmer than it conventionally is, that is desirable. The resistivity of the safety release biasing spring 40 to being rotated will tend to discourage a child (at least the youngest children) from rotating the safety release 29 far enough to cause the probe 56 to stand within the area of clearance 61. It is possible that, even if the child has noticed that an adult rotates the safety release 29, when the child tries it, the rapidly increasing resistance to rotation may cause the child to believe that it is not supposed to be rotated as far as is in fact necessary.

With a firm grasp on opposed sides of the safety release 29 between thumb and forefinger, the adult user now rotates the probe 56 around the wall segment 70 as far as is indicated by arrow 80 in FIG. 8; that is, until any further rotation of the safety release 29 is stopped by abutment of the probe 56 against the stop wall 75. The probe 56 is at this time strongly biased both rotationally toward its rest position 59 and also horizontally toward the vertical axis 54. Letting go of the safety release 29 when the probe 56 is held against the stop wall 75 allows the probe 56 to respond to the combined rotational and horizontal return biases effective upon it. The probe 56 has a return bias path that describes a spiral. The inside corner 77 (FIG. 2) is located in that return bias path. Accordingly, when the user lets go of the safety release 29, the probe 56 will necessarily enter into the inside corner 77 (FIG. 2) and thereby be held at its alternate position 60. Wall segment **72*a* is spaced apart from stop wall 75 far enough to accept the probe 56 therebetween but preferably with little room to spare, so that the probe 56 must be being held firmly against the stop wall 75 (so that the probe 56 is fully clear of the corner 72) at the moment that the user lets go of the safety release 29, or else, the probe 56 will bypass the corner 72 and not enter into the inside corner 77**. This is a further factor decreasing the likelihood of successful operation by a child.

Figure 9:
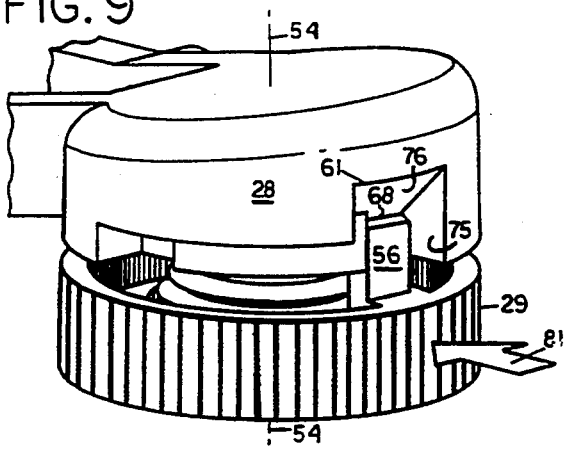

FIG. 9 shows the probe 56 having responded to its horizontal return bias by moving in the direction indicated by arrow 81. Arrow 81 does not appear in FIG. 1 because movement of the safety release 29 in the direction indicated by arrow 81 will occur automatically after the operation described immediately above, and, accordingly, is not a manipulation of the safety release 29 that the user will have to directly effect. The required manipulation is therefore properly termed a "Press and Turn" action because the arrow 81 movement occurs by itself if the "Press and Turn" movements were properly done as described above. The safety release biasing spring 40 is now again in its at rest condition (compare with FIG. 8 which shows a distorted vertical alignment of the coils of the safety release biasing spring 40). The probe 56 stands now at the lower edge 68 (a boundary in common with wall segment 66) of the wedge surface 76. Any downward movement of the wedge surface 76 will necessarily result in outboard movement of the probe 56.

Figure 10:
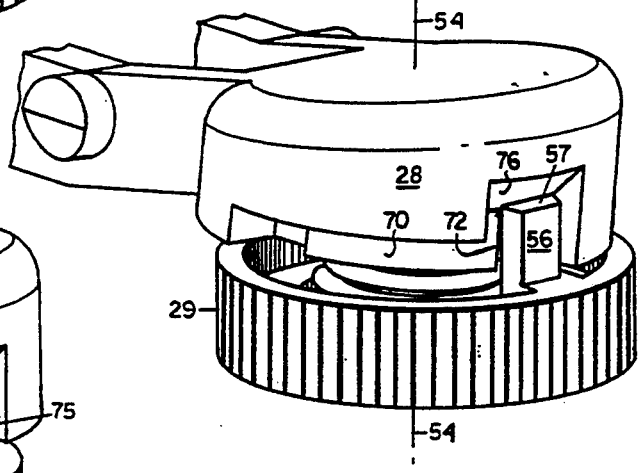
Figure 11:
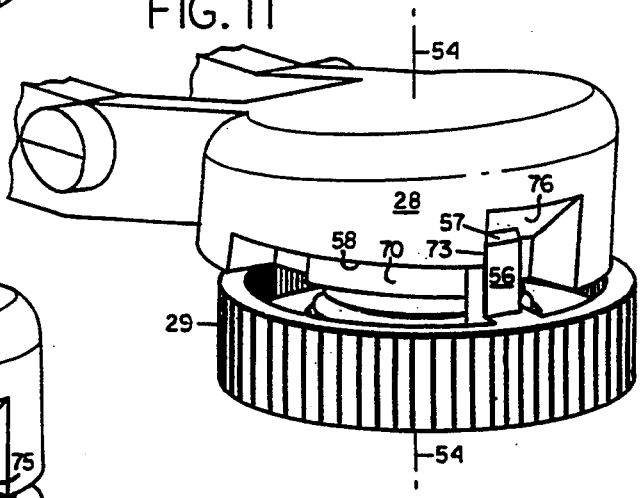

Referring to FIG. 10 which shows the pushbutton 28 is depressed position, the wedge surface 76 has forced the probe 56 outwardly far enough to clear the corner 72 of wall segment 70 whereby the probe 56 is now free to respond to its rotational return bias. The probe 56 does not actually stop where shown in FIG. 10—FIG. 10 being a "freeze frame" representation of the action presented so that the reader may see what is happening. Actually, the probe 56 instantly moves to the position shown in FIG. 11 in response to its rotational return bias. As seen in FIG. 11, which shows the pushbutton 28 still being held in its depressed position, the probe 56 instantly rotates to a position in abutment against the undersurface end wall 73. The probe 56 has thereby positively circumvented the inside corner 77 that has held the probe 56 at its alternate position 60. The probe 56 will remain in the position shown in FIG. 11 so long as the pushbutton 28 continues to be held in its depressed position because the lowered elevation of the undersurface 58 keeps its end wall 73 blocking further rotation of the probe 56 back toward its rest position 59.

Of course, the pushbutton 28 was depressed against the compressive resistance of the safety release biasing spring 40, which compression, when the pushbutton 28 is released, returns the pushbutton 28 to its normal elevation, and, likewise, returns the undersurface 58 to its normal elevation, thereby lifting the end wall 73 clear of the free end 57 of the probe 56.

Figure 7:
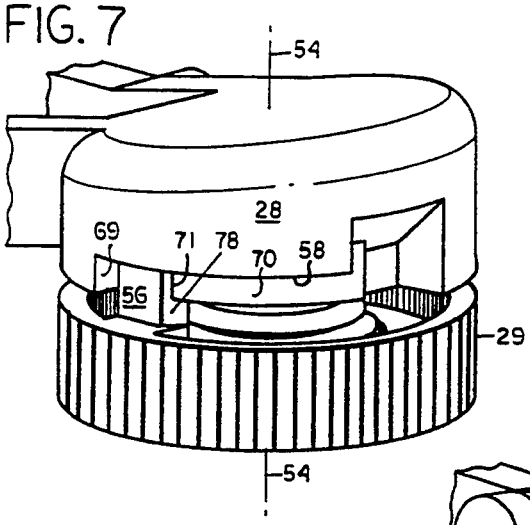
FIGS. 7 through 11, inclusive, are similar perspective views of the structure of FIG. 2 but in assembled relationship and with the safety release biasing spring mounted therebetween, showing the multiple-step mode of operation depicted by the arrows of FIG. 1. Specifically, FIG. 7 corresponds with FIG. 1 in that FIG. 7 likewise shows the probe at its rest position located within a first notch.

The rotational return bias still effective upon the probe 56 returns it to the position shown in FIG. 8; i.e., the probe 56 moves in a direction opposite to that indicated by arrow 80 in FIG. 8; and, in response to the horizontal return bias (which was imparted to the probe 56 by the outward movement of it shown in FIG. 10), the probe 56 moves back into the position shown in FIG. 7.

"Double Twist" Mode of Operation

FIGS. 12–15 illustrate the very same lighter shown in FIGS. 1–11 except that a specifically different pushbutton has been substituted for the one used in the FIGS. 1–11 embodiment. The substitute pushbutton has been designated **28*a* to indicate that there is general similarity to, but that a difference exists as compared to the previously described pushbutton 28. Pushbutton 28*a* is identical in all respects to pushbutton 28** except for the arrangement of the wall structure that extends between the probe's rest and alternate positions.

It is to be understood that, except for the differences specific to substitute pushbutton **28*a*, the embodiment illustrated in FIGS. 12–15, includes every other component in exactly the same form as previously described in connection with FIGS. 1–11. Every such other component and aspect thereof previously described in connection with FIGS. 1–11, exists and shall be understood to be included by reference in the embodiment illustrated in FIGS. 12–15. In FIGS. 12–15 only pushbutton 28*a* has a new number designation because all other components are the same ones previously described. Aspects of pushbutton 28*a* which are identical to corresponding aspects of the previously described pushbutton 28 retain their original number designation. Aspects of pushbutton 28a which are changed in any manner from their counterparts in the previously described pushbutton 28** reflect such changed relationship by attachment of the lower case letter "a" to the original number designation. Entirely new elements are assigned new numbers.

Let it be clearly understood then, that, although not appearing in FIGS. 12–15, the safety release biasing spring 40 exists and is mounted between pushbutton 28a and safety release 29 in exactly the same way as described in connection with FIGS. 1–11; i.e., in FIGS. 13–15, pushbutton 28a has been sectioned in a zig-zag manner to expose only the portion that is of immediate interest and to conceal the recess 41 and split boss 42 previously described in connection with FIGS. 1–11.

Further, only a relatively small portion of pushbutton 28a is different from pushbutton 28. Aspects of pushbutton 28a which are now familiar because previously described in connection with pushbutton 28 include the wedge surface 76 (see FIG. 13), stop wall 75 and wall segment 66 all located at the alternate position 60 of the probe 56.

All the above being understood, the following description is confined to only those aspects which are different from what has previously been described.

FIG. 12 shows pushbutton 28a substituted for pushbutton 28. Pushbutton 28a imposes upon the user of the lighter a "Double Twist" mode of manipulation of the safety release 29 in order render the normally locked pushbutton 28a depressible. The user must first rotate the safety release 45 degrees in the direction indicated by arrow 82, then pull it approximately 1/16th of an inch in the direction indicated by arrow 83, and finally rotate the safety release another 45 degrees, in order to effect movement of probe 56 from its rest position 59 to its alternate position 60.

Referring to FIG. 13 which shows the arrangement of wall structure of pushbutton 28a that imposes such mode of manipulation, as stressed above, safety release 29 is exactly the same as previously described, and, accordingly, includes probe 56 having free end 57 and acute-angled bevel 78. In FIG. 13, the probe 56 is standing at its rest position 59. Wall segment 65a extends arcuately about and at a uniform radial length from vertical axis 54. Wall segment 65a originates at wall segment 69a (FIG. 14), and terminates at wall segment 85. Wall segment 85 effects a barrier that prevents direct rotation of probe 56 from its rest position 59 to its alternate position 60. Safety release 29 must be pulled horizontally (arrow 83, FIG. 12) in order to circumvent wall segment 85.

Wall segment 86 extends arcuately about and at a uniform radial length from vertical axis 54, but spaced apart parallel to wall segment 65a to create a channel therebetween through which probe 56 is movable. Wall segment 86 thereby permits only rotational movement of probe 56 (arrow 82, FIG. 12). Wall segment 86 terminates at an end 87 that is spaced apart from wall segment 85 to define a gap 88 (FIG. 15) therebetween through which gap 88 the probe 56 is passable in order to circumvent wall segment 85.

The inner surface 89 of wall segment 86 is arcuately aligned with wall segment 70a.

All aspects of pushbutton 28a which are located within the alternate position 60 area, are identical to that previously described in connection with FIGS. 1–11 and, accordingly, will not be again described.

Referring to FIG. 14 and partially reiterating the above, wall segment 86 permits only rotational movement of the probe 56 from its rest position 59 (FIG. 13) but rotation all the way to its alternate position 60 (FIG. 13) is prevented by wall segment 85. The safety release 29 must be pulled horizontally (arrow 83, FIG. 12) in order to pull the probe 56 around wall segment 85.

A child in the critical age group, without deliberately trying to do so but simply because his motor skills are not yet fully developed, might inadvertently apply a compound force to the safety release 29; that is, while trying only to rotate it (because he has seen adults do that), he might at the same time also be pulling it (even though too slight a movement for the child to have observed) in the correct direction (arrow 83, FIG. 12). Given the slipperiness of the plastic composition likely to be used in the molding of these components, it is conceivable that if the child rotated the safety release as far as it will turn while simultaneously pulling it, the probe could slide around the barrier effected by wall segment 85 and thereby discover that the safety release is further rotatable; perhaps even rotate the probe all the way to its alternate position. Pushbutton 28a is designed to require certain information and fine motor skill to precisely align the probe 56 with the gap 88. The probe 56 must be rotated not only far enough, but also, not too far.

FIG. 14 shows the probe 56 rotated 45 degrees to a position where it is precisely aligned to pass through the gap 88 (FIG. 15). This is calculated to be difficult for children in the critical age group to do because the probe 56 will be resisting rotation and thereby require application of a controlled magnitude of force maintained long enough to pull the probe 56 through the gap 88. On the other hand, an adult, being instructed what is required, and, following the procedure described below, will find that, at least with practice, the action is quite easy to perform.

Referring back to FIG. 13, wall segment 85 intersects at an acute angle with wall segment 65a to define corner 90 that is shaped to correspond with the angle of bevel 78.

Referring simultaneously to FIGS. 14 and 15, FIG. 14 shows the probe 56 rotated to a position precisely aligned with gap 88. If the probe 56 is initially rotated beyond the position shown in FIG. 14 (i.e., more than 45 degrees), bevel 78 will enter into corner 90 and prevent pulling of safety release 29 horizontally as indicated by arrow 83 in FIG. 12. Even if probe 56 is rotated slightly short of corner 90, because of the angle of wall segment 85, bevel 78 will tend to "hook" it and again prevent pulling the probe 56 through the gap 88. Accordingly, the probe 65 must be properly aligned with the gap 88 before it can be pulled through it. The adult is instructed to first rotate the probe 56 as far as it will go in order to locate or establish, by "feel" a reference position, and then back it off a little. With practice, this soon becomes quite easy to do.

Finally, FIG. 15 shows safety release 29 having been pulled horizontally away from vertical axis 54 in the direction indicated by arrow 83 of FIG. 12 whereby the probe 56 has been pulled through the gap 88 and is now located outboard of wall segment 70a. Probe 56 can now be rotated as indicated by arrow 84 of FIG. 84 all the way to and until stopped by stop wall 75. The action from that point on is identical to that previously described in connection with pushbutton 28.

DETAILED DESCRIPTION OF TYPE 2 CHILD-RESISTANCE LIGHTER

In FIGS. 16–18, where components or aspects thereof are the same ones previously described, the same number designation is retained and where any change has been made in a previously described component or aspect thereof, the lower case letter "a" is appended to the prior number designation to indicate relationship but with a difference. Entirely new elements are assigned new numbers.

Conventional Elements

FIG. 16 illustrates a Type 2 lighter having pushbutton 28b cooperating with safety release 29a. The Type 2 lighter has a housing indicated generally as 20a having an upper end portion 21a that is molded separately from and attached to its main body portion 22a. Skipping FIG. 17 and referring to FIG. 18, the Type 2 lighter typically comprises a main body portion 22a defining a fuel compartment 39a that is formed so as to be closed at the bottom and is initially open at the top but then permanently fitted with a plug component 91. A valve body 92 threaded into the plug component 91 communicates with the fuel compartment 39a, includes a vertically slidable nozzle element 93 and a valve/pushbutton biasing spring (not shown) that is incorporated in the valve body 92 and biases the nozzle element 93 downwardly. The upper end portion 21a is a superstructure that secures a snapped-on attachment (via internal bosses that engage recesses 94, 95) to the plug component 91. The upper end portion 21a conventionally includes a horizontal top wall 25a having opposed free edges 26a, 27a. The upper end portion 21a conventionally includes a pair of parallel spaced apart tabs 34a, 35a which are provided with openings for pivotally mounting a lever 30a (FIG. 17) and rotatably mounting a flintwheel 24a (FIG. 16); e.g., opening 96 in tab 35a is one of a pair provided for pivotally securing lever 30a, and opening 37 in tab 35a is one of a pair provided for rotatably securing the flintwheel 24a. A flint support column 97 extends upwardly (rectangular shape) and downwardly (cylindrical shape) from top wall 25a and includes a bore 98 for receipt of a flint (not shown) with underlying spring (not shown) which biases the flint upwardly against the flintwheel 24a. When finally assembled, the valve body 92 extends through an opening 99 provided in top wall 25a, nozzle element 93 is engaged with the forward end of lever 30a and a flame adjustment lever 100 is fitted around and extends forwardly from the valve body 92 for adjusting its threaded fit into the plug component 91, all as shown in FIG. 17. The cylindrical forms at 101 and 102 are, in each case, integrally molded portions of the plug component 91; 101 providing a housing (open at the bottom) for a received portion of the valve body 92 and securing one end of a wick or fuel tube 103; 102 providing a housing (closed at the bottom for a received portion of the downwardly extending portion of the flint support column 97.

The drawings reflect, as accurately as possible, the proportions which are typical of a current Type 2 disposable lighter product. The conventional proportions do not permit practical mounting of a cylindrical safety release having a diameter large enough that it is operable by grasping opposite sides thereof between thumb and forefinger. In FIG. 18, the numeral 104 points to the rearward end of the main body portion 22a. Conventionally, the upper end portion 21a is proportioned so as to effectively be a smooth upward continuation of the main body portion 22a. Therefore, conventionally, the upper end portion 21a has its rearward end at 105 whereby it is located in the same vertical plane at the rearward end 104 of the main body portion 22a. In order to be conveniently graspable between thumb and forefinger, the safety release 29a needs to have an outside diameter the dimension of which is preferably at least equal to, if not greater than, the dimension between edge 26a and edge 27a of top wall 25a (a "lateral" dimension). This lateral dimension is determinative of the minimum outside diameter which the safety release 29a must have; and that diameter, in turn, determines where the vertical axis 54 will be located. Conventionally, there is not enough room for installation of a suitable safety release biasing spring 40a either on or within the upper end portion 21a.

MODIFICATIONS IMPLEMENTING THE INVENTION

The upper end portion 21a overcomes the space limitation of its conventional counterpart by an extension 106 that curves into the conventional rearward end 105 whereby the modified upper end portion 21a is usable with the conventional main body portion 22a.

Upper end portion 21a differs further from its conventional counterpart by inclusion of a recess indicated generally as 107 that is deep enough to fully contain the safety release biasing spring 40a. The recess 107 is given effect by a cylindrical wall 108 that depends from and is molded integrally with the top wall 25a, the cylindrical wall 108 having its lower end closed by bottom 109 from which rises a split boss 51a having notch 52a for receipt of the lower end 53a of safety release biasing spring 40a.

Plug component 91 differs from its conventional counterpart by virtue of being shaped to provide clearance (creating the surfaces 109, 110) as necessary to accommodate the cylindrical wall 108 while maintaining the seal effected by the plug component 91. Note that a small portion 112 of plug component 91 extends upwardly above the rim 113 of the main body portion 22a. When finally assembled, the rearward end 105 fits around the portion 112 and on top of the rim 113.

The safety release 29a includes a split boss 42a that depends from its underside, split boss 42a effecting notch 43a for receipt of the upper end 44a of safety release biasing spring 40a.

Note that the coils of safety release biasing spring 40a are wound in a direction that is appropriate for its mounting under (as opposed to on top of) safety release 29a, whereby, when safety release 29a is rotated in the direction indicated by arrow 63 in FIG. 16, the coils will necessarily be wound tighter. (This winding is opposite to that of safety release biasing spring 40.)

Safety release biasing spring 40a will not have to function as a valve/pushbutton biasing spring because such spring is already provided inside the valve body 92. Accordingly, safety release biasing spring 40a is not under partial compression when finally assembled and, therefore, the height of it as shown in FIG. 18 is its final height.

"Press and Turn" Mode of Operation

Arrows 62 and 63 in FIG. 16 indicate that safety release 29a has the previously described "Press and Turn" mode of operation. As shown in FIG. 17, that portion of pushbutton 28b that effects the "Press and Turn" action is identical to the corresponding portion of pushbutton 28 previously described and comprises all the same elements, including, undersurface 58, wall segment 70, stop wall 75 and wedge surface 76 within clearance 61. The only difference that application to a Type 2 lighter makes is that since pushbutton **28*b*** does not have to accommodate a spring, its central area is solid. Since the configuration and mode of operation of the "Press and Turn" pushbutton is fully described above in connection with the Type 1 lighter having a "Press and Turn" action, such description not repeated here.

"Double Twist" Mode of Operation

Effectively provided and obvious in view of the above. Specifically, see FIGS. 16–18 and text under headings "Conventional Elements" and "Modifications Implementing the Invention" for illustration and description of Type 2 lighter including modifications thereof incorporating the invention safety release and safety release biasing spring and their arrangement relative to the lighter's pushbutton; and see FIGS. 12–15 and text under the heading "'Double Twist' Configuration of Pushbutton" for illustration and description of configuration of pushbutton that effects a "Double Twist" multiple-step mode of operation.

Anticipated Alternative Arrangements

There has been described above (i) conventional Type 1 and Type 2 disposable lighter products in the form in which they are currently being manufactured and (ii) arrangements of the invention therein which require the least possible modification of such current lighter products. It is within the skill of the mechanic to combine a feature conventionally characterizing a Type 1 lighter with a feature conventionally characterizing a Type 2 lighter and thereby develop a third type of lighter that is a hybrid of the two; e.g., the Type 1 lighter could incorporate a valve/pushbutton biasing spring within the body of its valve mechanism like a Type 2 lighter; or, the Type 2 lighter could adopt the unitary body construction of the Type 1 lighter (i.e., form the upper end portion in one piece with the main body portion). It is also within the skill of the mechanic to combine one of the invention's features disclosed above in connection with a Type 1 lighter with another of the invention's features disclosed above in connection with a Type 2 lighter; e.g., instead of the construction and arrangement as shown in FIG. 18, the Type 2 lighter can be provided with the construction of safety release and corresponding top-side arrangement of safety release biasing spring shown in FIG. 3.

Conclusion

The drawings have illustrated, and the text has described, what is believed to be an ideal solution for each of the two described types of conventional disposable lighter products, enabling conversion of either type into a highly effective child-resistance lighter that, on the one hand, meets the industry's requirements for economical manufacture, and, on the other hand, fully satisfies not only the expectation of the petition referred to at the outset hereof but also all presently proposed CPSC regulations. Moreover, for each of the two described types of lighters, two significantly different child-resistance-effecting mechanisms have been disclosed; and in addition, it has been shown that either of the two described types of lighters can economically be converted from one to the other of said significantly different child-resistance-effecting mechanisms.

I claim:

1. A lighter comprising:

a housing having a fuel compartment;

fuel release means for releasing fuel to be ignited from said fuel compartment;

means for igniting said released fuel;

a thumb-depressible pushbutton having an undersurface with first and second portions defining first and second surfaces, respectively, of low and high elevations from a top portion of said housing, said pushbutton operatively engaged with said release means such that when depressed fuel is released; and a safety release member being movable in a first direction and a second direction by user manipulation in each direction to move said release member from a first configuration to a second configuration, wherein said release member in said first configuration is positioned beneath said first portion for preventing said pushbutton from being depressed by abutting said first surface of low evaluation, and wherein movement of said release member by the user along said first direction and then along said second direction into said second configuration causes said release member to be positioned beneath said second portion having said second surface of high elevation forming a void between said release member and said second surface, thereby allowing said pushbutton to be depressed by receiving said release member into said void.

2. A lighter according to claim 1 wherein said safety release member includes a probe member having a free end mounted on said top portion of said housing, said free end opposing said undersurface.

3. A lighter according to claim 1 further comprising biasing means positioned between said safety release member and a suitable structure portion of said housing for resiliently resisting the movement of said release member from said first configuration to said second configuration.

4. A lighter according to claim 3 wherein said biasing means is a coil spring in a conical helical form.

5. A lighter according to claim 1 wherein said safety release member is generally cylindrically shaped having a longitudinal axis along a direction in which said thumb-depressible pushbutton is depressed.

6. A lighter according to claim 5 wherein said first direction is along a direction laterally away from said longitudinal axis, and said second direction is along a direction concentric about said longitudinal axis.

7. A lighter according to claim 6 wherein said first and second portions are spaced apart along an arc segment about said longitudinal axis.

8. A lighter according to claim 1 wherein said second portion includes an upper wedge surface abutting said safety release member when said pushbutton is depressed thereby causing said release member to move simultaneously along said first and second directions such that when said pushbutton is released said biasing means returns said release member to said first configuration.

9. A lighter according to claim 1 wherein said first portion further includes first and second lateral wall segments such that said first upper surface and said first and second lateral wall segments define a first notch for receiving said safety release member when in said first configuration.

10. A lighter according to claim 1 wherein said second portion further includes third and fourth lateral wall segments such that said second upper surface and said third and fourth lateral wall segments define a second notch for receiving said safety release member when in said second configuration.

11. A lighter comprising:

a housing having a fuel compartment;

fuel release means for releasing fuel to be ignited from said fuel compartment;

means for igniting said released fuel;

a thumb-depressible pushbutton having an undersurface with first and second portions defining first and second surfaces, respectively, of low and high elevations from a top portion of said housing, said pushbutton operatively engaged with said release means such that when depressed fuel is released; and a user-manipulable safety release member in a first configuration positioned beneath said first portion for preventing said pushbutton from being depressed by abutting said first surface of low evaluation, wherein movement of said release member by a user along a first direction, then along a second direction, and then again along said first direction into a second configuration causes said release member to be positioned beneath said second portion having said surface of high elevation forming a spacing therebetween, thereby allowing said pushbutton to be depressed.

12. A lighter according to claim 11 wherein said safety release member includes a probe member having a free end mounted on said top portion of said housing, said free end opposing said undersurface.

13. A lighter according to claim 11 further comprising biasing means positioned between said safety release member and a suitable structure portion of said housing for resiliently resisting the movement of said release member from said first configuration to said second configuration.

14. A lighter according to claim 13 wherein said biasing means is a coil spring in a conical helical form.

15. A lighter according to claim 11 wherein said safety release member is generally cylindrically shaped having a longitudinal axis along a direction in which said thumb-depressible pushbutton is depressed.

16. A lighter according to claim 15 wherein said first direction is along a direction concentric about said longitudinal axis and said second direction is along a direction laterally away from said longitudinal axis.

17. A lighter according to claim 16 wherein said pushbutton further includes a wall segment for preventing said safety release member from moving along said first direction from said first configuration to said second configuration unless said safety release member is moved along said second direction, said wall segment lying along said first direction.

18. A lighter according to claim 16 wherein said first and second portions are spaced apart along an arc segment about said longitudinal axis.

19. A lighter according to claim 11 wherein said second portion includes an upper wedge surface abutting said safety release member when said pushbutton is depressed thereby causing said release member to move simultaneously along said first and second directions such that when said pushbutton is released said biasing means returns said release member to said first configuration.

20. A lighter according to claim 11 wherein said first portion further includes first and second lateral wall segments such that said first upper surface and said first and second lateral wall segments define a first notch for receiving said safety release member when in said first configuration.

21. A lighter according to claim 11 wherein said second portion further includes third and fourth lateral wall segments such that said second upper surface and said third and fourth lateral wall segments define a second notch for receiving said safety release member when in said second configuration.

* * * * *

UNITED STATES PATENT AND TRADEMARK OFFICE
CERTIFICATE OF CORRECTION

PATENT NO. : 5,417,563

DATED : May 23, 1995

INVENTOR(S) : McDonough et al.

It is certified that error appears in the above-identified patent and that said Letters Patent is hereby corrected as shown below:

Claim 1, column 26, line 23: change "evaluation" to --elevation--.
Claim 8, column 26, line 57: change "1" to --3--.
Claim 11, column 27, line 24: change "evaluation" to --elevation--.
Claim 19, column 28, line 23: change "11" to --13--.

Signed and Sealed this

Twelfth Day of December, 1995

*Attest:*

*Attesting Officer*

BRUCE LEHMAN

*Commissioner of Patents and Trademarks*